US007119782B2

(12) United States Patent
Sunohara et al.

(10) Patent No.: US 7,119,782 B2
(45) Date of Patent: Oct. 10, 2006

(54) DISPLAY DEVICE AND DRIVING METHOD OF THE SAME

(75) Inventors: Makoto Sunohara, Kanagawa (JP); Akimitsu Tajima, Kanagawa (JP); Masayuki Yamaguchi, Kanagawa (JP); Masayuki Kumeta, Kanagawa (JP)

(73) Assignee: NEC Electronics Corporation, Kanagawa (JP)

( * ) Notice: Subject to any disclaimer, the term of this patent is extended or adjusted under 35 U.S.C. 154(b) by 396 days.

(21) Appl. No.: 10/422,774

(22) Filed: Apr. 25, 2003

(65) Prior Publication Data

US 2003/0201965 A1 Oct. 30, 2003

(30) Foreign Application Priority Data

Apr. 26, 2002 (JP) ..... 2002-127484

(51) Int. Cl.
*G09G 3/36* (2006.01)

(52) U.S. Cl. ..... 345/100; 345/204

(58) Field of Classification Search ..... 345/3.3, 345/99, 100, 211–213
See application file for complete search history.

(56) References Cited

U.S. PATENT DOCUMENTS 6,046,737 A 4/2000 Nakamura
6,181,318 B1 * 1/2001 Lim ..... 345/698
6,597,229 B1 7/2003 Koyata et al.
2002/0003242 A1 1/2002 Uchiyama
2004/0012580 A1 * 1/2004 Yamagishi et al. ..... 345/204
2004/0217932 A1 * 11/2004 Nally et al. ..... 345/92
2005/0024311 A1 * 2/2005 Takahashi et al. ..... 345/89
2005/0093488 A1 * 5/2005 Hung et al. ..... 315/307

FOREIGN PATENT DOCUMENTS

JP 09-218670 8/1997
JP 2001-053598 2/2001
JP JP 2001-053598 2/2001
JP 2002--26231 1/2002

* cited by examiner

*Primary Examiner*—Amare Mengistu
(74) *Attorney, Agent, or Firm*—Foley & Lardner LLP

(57) ABSTRACT

A display device is provided with a display controller, a source driver, and a liquid crystal panel, and two pairs of wirings are provided between the display controller and the source driver. The display controller is provided with a V-I conversion circuit for image data and a mode register, and the source driver is provided with an I-V conversion circuit for image data. The V-I conversion circuit for image data connects either one of a pair of the wirings to an earth electrode and sets the other one to a floating state based on the image data. The I-V conversion circuit for image data allows electric current to flow in the wiring out of a pair of the wirings, which is connected to the earth electrode, and converts the image data into a pair of complementary current signals to receive them. Further, the I-V conversion circuit for image data stops the current signal by a control signal from the mode register when the image data is not transmitted.

14 Claims, 15 Drawing Sheets

DISPLAY DEVICE AND DRIVING METHOD OF THE SAME

BACKGROUND OF THE INVENTION

1. Field of the Invention

The present invention relates to a matrix type display device that uses electric current as transmitting signal, and a driving method thereof.

2. Description of the Related Art

The matrix type display device such as a liquid crystal display device and a plasma display panel (also referred to as PDP) is provided with a display controller that sequentially outputs image data, a source driver that generates a drive signal for driving a display panel based on the image data output from the display controller, and a display panel that displays an image by the drive signal.

In such a display device, the signal between the display controller and the source driver has conventionally been transmitted by a voltage signal that consists of two values of power source potential and earth potential. However, parasitic capacitance of transmission path causes delay if the voltage signal is made to be high-speed, and the level of high-speed voltage signal is limited.

The applicant then developed a technique of transmitting a signal by electric current, which is disclosed in Japanese Patent Application Laid-open No. 2001-053598. This technique restricts the affect of the parasitic capacitance of the transmission path, and the high-speed signal can be realized. Further, Japanese Patent Application Laid-open No. 2001-053598 also discloses a technique that a power source is not provided for a transmission section but for a receiving section. Thus, it is not necessary to change the specification of the transmission section even if the number of the receiving sections is changed, and the design of the transmission section becomes easy.

Specifically, a pair of wirings for transmitting signal is provided between the transmission section and the receiving section. Then, in the transmission section, one of the wirings is connected to an earth electrode and the other wiring is set to a floating state (high-impedance state) based on a signal intended to transmit. Accordingly, electric current flows from the power source provided for the receiving section to the earth electrode via the wiring connected to the earth electrode and the electric current does not flow to the other wiring. As a result, it is possible to transmit a complementary signal by a pair of the wirings. The applicant has named the transmission method as CMADS (Current Mode Advanced Differential Signaling).

FIG. 1 is a block diagram showing a conventional liquid crystal display device for which the CMADS was applied. As shown in FIG. 1, the conventional liquid crystal display device is provided with a display controller 101, a source driver 102, and a liquid crystal panel 103. Further, two pairs of wirings 104*a* and 104*b*, 105*a* and 105*b* are provided between the display controller 101 and the source driver 102.

The display controller 101 is one to which image data as digital two-value voltage signal is input from outside and that outputs the image data by every line. The display controller 101 is provided with a display data memory 106, a timing control circuit 107, a V-I conversion circuit for image data 108, and a V-I conversion circuit for clock signal 109. The display data memory 106 is one to which the image data is input from outside and that holds the image data for one screen. The timing control circuit 107 reads out the image data equivalent to one line from the display data memory 106, outputs a clock signal to the V-I conversion circuit for clock signal 109, and sequentially outputs the image data equivalent to one line to the V-I conversion circuit for image data 108 synchronously with the clock signal. The V-I conversion circuit for image data 108 is connected to one end of a pair of the wirings 104*a* and 104*b*, in which either one of the wirings 104*a* and 104*b* is connected to the earth electrode and the other wiring is set to the floating state based on the image data. The V-I conversion circuit for clock signal 109 is connected to one end of a pair of the wirings 105*a* and 105*b*, in which either one of the wirings 105*a* and 105*b* is connected to the earth electrode and the other wiring is set to the floating state based on the clock signal.

Furthermore, the source driver 102 is provided with an I-V conversion circuit for image data 121, an I-V conversion circuit for clock signal 122, a shift register 123, a data latch circuit 124, a gradation selecting circuit 125, and an output circuit 126. The I-V conversion circuit for image data 121 is connected to the other end of a pair of the wirings 104*a* and 104*b*. Then, when the V-I conversion circuit for image data 108 connects either one of the wirings 104*a* and 104*b* to the earth electrode, The I-V conversion circuit for image data 121 allows electric current to flow in the wiring connected to the earth electrode to generate a complementary current signal in a pair of the wirings 104*a* and 104*b*. Consequently, the I-V conversion circuit for image data 121 receives the image data as the current signal from the V-I conversion circuit for image data 108. Then, the I-V conversion circuit for image data 121 converts the image data again into the two-valued voltage signal based on the current signal, and outputs the signal to the data latch circuit 124. The I-V conversion circuit for clock signal 122 is connected to the other end of a pair of the wirings 105*a* and 105*b*. Then, when the V-I conversion circuit for clock signal 109 connects either one of the wirings 105*a* and 105*b* to the earth electrode, the I-V conversion circuit for clock signal 122 allows electric current to flow in the wiring connected to the earth electrode to generate the complementary current signal in a pair of the wirings 105*a* and 105*b*. Consequently, the I-V conversion circuit for clock signal 122 receives the clock signal as the current signal from the V-I conversion circuit for clock signal 109. Then, the I-V conversion circuit for clock signal 122 converts the clock signal again into the two-valued voltage signal based on the current signal, and outputs the signal to the shift register 123.

The shift register 123 is one to which the clock signal is input and that sequentially outputs pulse signals from a plurality of output terminals to the data latch circuit 124. The data latch circuit 124 downloads a plural image data synchronously with the pulse signals to output a plurality of the image data to the gradation selecting circuit 125 simultaneously. The gradation selecting circuit 125 is a D/A converter, which performs digital-analog conversion (D/A conversion) to the output signal from the data latch circuit 124 and outputs a gradation signal that is an analog voltage signal to an output circuit 126. The voltage of the gradation signal is a voltage applied for each pixel of the liquid crystal panel 103. The output circuit 126 performs current amplification to the gradation signal to generate a drive signal, and outputs the drive signal to each pixel of the liquid crystal panel 103.

Moreover, the liquid crystal panel 103 is provided with two transparent substrates (not shown) arranged facing with each other, a liquid crystal layer (not shown) sandwiched between the transparent substrates, and a backlight (not shown) arranged behind the two transparent substrates. Further, pixels (not shown) are arranged in a matrix state on the liquid crystal panel 103.

Next, description will be made for the operation of the conventional liquid crystal display device. Firstly, the image data as the two-valued voltage signal is input to the display data memory 106, and the data equivalent to one screen is held. Then, the timing control circuit 107 reads out the image data equivalent to one line from the display data memory 106. The timing control circuit 107 then outputs the clock signal that is the two-valued voltage signal to the V-I conversion circuit for clock signal 109. Further, the timing control circuit 107 sequentially outputs the image data to the V-I conversion circuit for image data 108 synchronously with the clock signal.

Next, the V-I conversion circuit for image data 108 connects one end of a pair of the wirings 104*a* and 104*b* to the earth electrode and sets the other wiring to the floating state based on the image data. For example, the wiring 104*a* is connected to the earth electrode and the wiring 104*b* is set to the floating state when the image data is high, and the wiring 104*a* is set to the floating state and the wiring 104*b* is connected to the earth electrode when the image data is low. Further, the V-I conversion circuit for clock signal 109 connects one end of a pair of the wirings 105*a* and 105*b* to the earth electrode and sets the other wiring to the floating state based on the clock signal.

Accordingly, the I-V conversion circuit for image data 121 allows electric current to flow in either wiring of a pair of the wirings 104*a* and 104*b*, which is connected to the earth electrode. The electric current flows from the I-V conversion circuit for image data 121 to the earth electrode via the wiring 104*a* or 104*b*. On the other hand, the electric current does not flow in the wiring on the floating state. As a result, the image data that is the voltage signal is converted into a pair of complementary current signals, and is transmitted from the V-I conversion circuit for image data 108 to the I-V conversion circuit for image data 121 via a pair of the wirings 104*a* and 104*b*. Then, the I-V conversion circuit for image data 121 converts the current signal into the two-valued voltage signal again to regenerate the image data, and outputs the data to the data latch circuit 124.

Similarly, the I-V conversion circuit for clock signal 122 allows the electric current to flow in either wiring of a pair of the wirings 105*a* and 105*b*, which is connected to the earth electrode. On the other hand, the electric current does not flow in the wiring on the floating state. As a result, the clock signal that is the voltage signal is converted into a pair of complementary current signals, and is transmitted from the V-I conversion circuit for clock signal 109 to the I-V conversion circuit for clock signal 122 via a pair of the wirings 105*a* and 105*b*. Then the I-V conversion circuit for clock signal 122 converts the current signal into the two-valued voltage signal again to regenerate the clock signal, and outputs the signal to the shift register 123.

The shift register 123 downloads the clock signal from the I-V conversion circuit for clock signal 122, and sequentially outputs the pulse signal from a plurality of output terminals to the data latch circuit 124. The data latch circuit 124 downloads a plurality of image data from the I-V conversion circuit for image data 121 synchronously with the pulse signal, and simultaneously outputs a plurality of the image data to the gradation selecting circuit 125. Next, the gradation selecting circuit 125 performs D/A conversion to the output signal to generate the gradation signal that is the analog voltage signal, and outputs the signal to the output circuit 126. Then, the output circuit 126 performs current amplification to the gradation signal to generate the drive signal, and applies it to each pixel of the liquid crystal panel 103.

On the other hand, in the liquid crystal panel 103, the backlight irradiates light to each pixel. Then, the liquid crystal layer of each pixel changes transmission factor of light according to the voltage of the drive signal applied, forms an image as the entire liquid crystal panel 103.

However, the above-described prior art has the following problems. Recently, a small display device such as a cellular phone in particular is normally equipped with a function such as a subtractive color mode to economize image data amount. The function subtracts colors of the image data from 260,000 colors to 8 colors, for example, and thus reducing the image data amount from 18 bits to 3 bits. In addition, a technique to encode and compress the image data has generally been used.

In the case of reducing the image data amount, dummy transfer is performed in signal transfer between the display controller and the source driver other than the data necessary for displaying the image. At this point, when the image data is transmitted by the voltage signal as conventionally performed, power consumption can be reduced by reducing the image data amount. However, when the image data is transmitted by the current signal, the electric current continuously flows in the wiring between the display controller and the source driver during the dummy transfer, and there exists a problem that the effects to reduce the power consumption is not obtained.

SUMMARY OF THE INVENTION

An object of the present invention is to provide a display device in which high-speed signal transmission and reduction of power consumption can be realized, and a driving method thereof.

A display device according to the present invention comprises a pair of or plural pairs of wirings for image data, a display controller that is connected to one end of the wirings for image data and outputs the image data by connecting either one of each pair of wirings for image data to a reference potential terminal and setting the other one to a floating state based on the image data, a source driver that is connected to the other end of the wirings for image data, generates a pair of or plural pairs of complementary current signals based on the image data by allowing electric current to flow in the wiring connected to the reference potential terminal out of a pair of or plural pairs of the wirings for image data and generates a drive signal based on the current signal when the display controller outputs the image data, and does not allow the electric current to flow in both of the wirings for image data when the display controller stops outputting the image data, and a display panel which displays an image based on the drive signal.

In the present invention, by generating the complementary current signal based on the image data, the current signal transmits through the wirings for image data. Thus, it is possible to transmit the image data in a high-speed. Further, when the display controller connects neither one of each pair of the wirings for image data to the reference potential terminal and does not set the other one to the floating state based on the image data, that is, when the output of the image data is stopped, the power consumption can be reduced by not allowing the electric current to flow in both of the wirings for image data.

Further, it is preferable that the display device have a pair of wirings for clock signal, the display controller be connected to one end of the wirings for clock signal, output the clock signal by connecting either one of a pair of the wirings for clock signal to the reference potential terminal and setting the other one to the floating state based on a clock signal, the source driver be connected to the other end of the wirings for clock signal, generate a pair of complementary current signals based on the clock signal by allowing electric current to flow in the wiring connected to the reference potential terminal out of a pair of the wirings for clock signal when the display controller outputs the clock signal, and do not allow the electric current to flow in both of the wirings for clock signal when the display controller does not output the clock signal.

Thus, by generating the complementary current signal based on the clock signal, the current signal transmits through the wirings for clock signal. Thus, it is possible to transmit the clock signal in a high-speed. In addition, when the output of the clock signal is stopped, it is possible to reduce power consumption by not allowing the electric current to flow in both of the wirings for clock signal.

Moreover, the display controller may have a timing control circuit that outputs a receiver control signal showing whether the display controller is outputting the image data or stops outputting the image data and an image data switching circuit that connects either one of each pair of the wirings for image data to the reference potential terminal and sets the other one to the floating state based on the image data output from the timing control circuit. And the source driver, when the receiver control signal shows that the display controller is outputting the image data, may generate a pair of or plural pairs of complementary current signals based on the image data by allowing the electric current to flow in the wiring connected to the reference potential terminal out of a pair of or plural pairs of the wirings for image data and regenerate the image data based on the current signal, and may stop allowing the electric current to flow in the wirings for image data connected to the reference potential terminal when the receiver control signal shows that the display controller stops outputting the image data.

Alternatively, the source driver may have a clock signal conversion circuit that generates a pair of complementary current signals based on the clock signal by allowing the electric current to flow in the wiring connected to the reference potential terminal out of a pair of the wirings for clock signal and regenerates the clock signal based on the current signal, and a detecting circuit for clock signal stop that detects whether the clock signal conversion circuit generates the current signal based on the clock signal or not, and may determine according to a detection result whether the display controller is outputting the clock signal or stops outputting the clock signal.

Alternatively, the display controller may have a timing control circuit that reads the image data of a predetermined amount to sequentially output the image data, a data comparing circuit that compares a predetermined amount of image data that the timing control circuit has read before one drive timing with a predetermined amount of image data currently read and outputs a result to the timing control circuit, and an image data switching circuit that connects either one of each pair of the wirings for image data to the reference potential terminal and sets the other one to the floating state based on the image data output from the timing control circuit. And, the timing control circuit may output the receiver control signal showing whether the display controller is outputting the image data or has stopped outputting the image data based on the comparison result of the data comparing circuit, and the source driver, when the receiver control signal shows that the display controller is outputting the image data, may generate a pair of or plural pairs of complementary current signals based on the image data by allowing the electric current to flow in the wiring connected to the reference potential terminal out of a pair of or plural pairs of the wirings for image data and regenerates the image data based on the current signal, and may stop allowing the electric current to flow in the wirings for image data connected to the reference potential terminal when the receiver control signal shows that the display controller stops outputting the image data.

Another display device according to the present invention has the wirings for image data, the display controller connected to one end of the wirings for image data, the source driver that is connected to the other end of the wirings for image data and generates the drive signal based on the image data sent out to the wirings for image data, and the display panel that displays an image based on the drive signal, and the display controller adjusts the frequency of the image data according to the display mode of the image.

In the present invention, by adjusting the frequency of the current signal according to the display mode, it is possible to lower the frequency of the current signal when the image data amount is small. Thus, the power consumption can be reduced.

Further, the display controller may have a mode register that outputs the control signal according to the display mode of image, and the timing control circuit that sequentially outputs the image data by a frequency adjusted based on the control signal and outputs the receiver control signal showing the display mode of the image. And the source driver may generate the drive signal based on the display mode of the image that the receiver control signal shows. Furthermore, a pair of or plural pairs of the wirings for image data may be provided, the display controller may have an image data switching control circuit that connects either one of each pair of the wirings for image data to the reference potential terminal and sets the other one to the floating state based on the image data, and the source driver may generate a pair of or plural pairs of complementary current signals based on the image data by allowing the electric current to flow in the wiring connected to the reference potential terminal out of the wirings for image data, may generate the drive signal based on the current signals, and may control the magnitude of the electric current allowed to flow in the wirings for image data according to the display mode of the image that the receiver control signal shows. Consequently, since a current value necessary for transmitting the current signal reduces in the display mode such as the subtractive color mode having smaller image data, the current value can be lowered. As a result, it is possible to restrict power consumption.

Further, the display panel may be a liquid crystal display panel, a plasma display panel, or an organic EL (Electro Luminescence) display panel.

The driving method of the display device according to the present invention has steps of: connecting either one of each pair of a pair of or plural pairs of the wirings for image data to the reference potential terminal to allow the electric current to flow and setting the other one to the floating state based on the image data to generate a pair of or plural pairs of complementary current signals based on the image data or not allowing the electric current to flow in both of the wirings for image data; generating the drive signal based on the current signal; and displaying an image based on the drive signal.

Another driving method of the display device according to the present invention comprises the steps of: generating a pair of complementary current signals based on the clock signal by connecting either one of a pair of wirings for clock signal to the reference potential terminal to allow the electric current to flow and setting the other one to the floating state based on the clock signal, generating a pair of a pair of or plural pairs of complementary current signals based on the image data by connecting either one of each pair of or plural pairs of wirings for image data to the reference potential terminal to allow the electric current to flow and setting the other one to-the floating state based on the image data, or not allowing the electric current to flow in both of the wirings for clock signal and the wirings for image data; generating the drive signal based on the current signal; and displaying an image based on the drive signal.

According to the present invention, as described above, when the image data is transmitted between the display controller and the source driver in the display device, the high-speed signal transmission and the reduction of power consumption can be realized by transmitting the image data by the current signal and stopping the electric current when the image data is not transmitted.

DETAILED DESCRIPTION OF THE EMBODIMENTS

Figure 1:
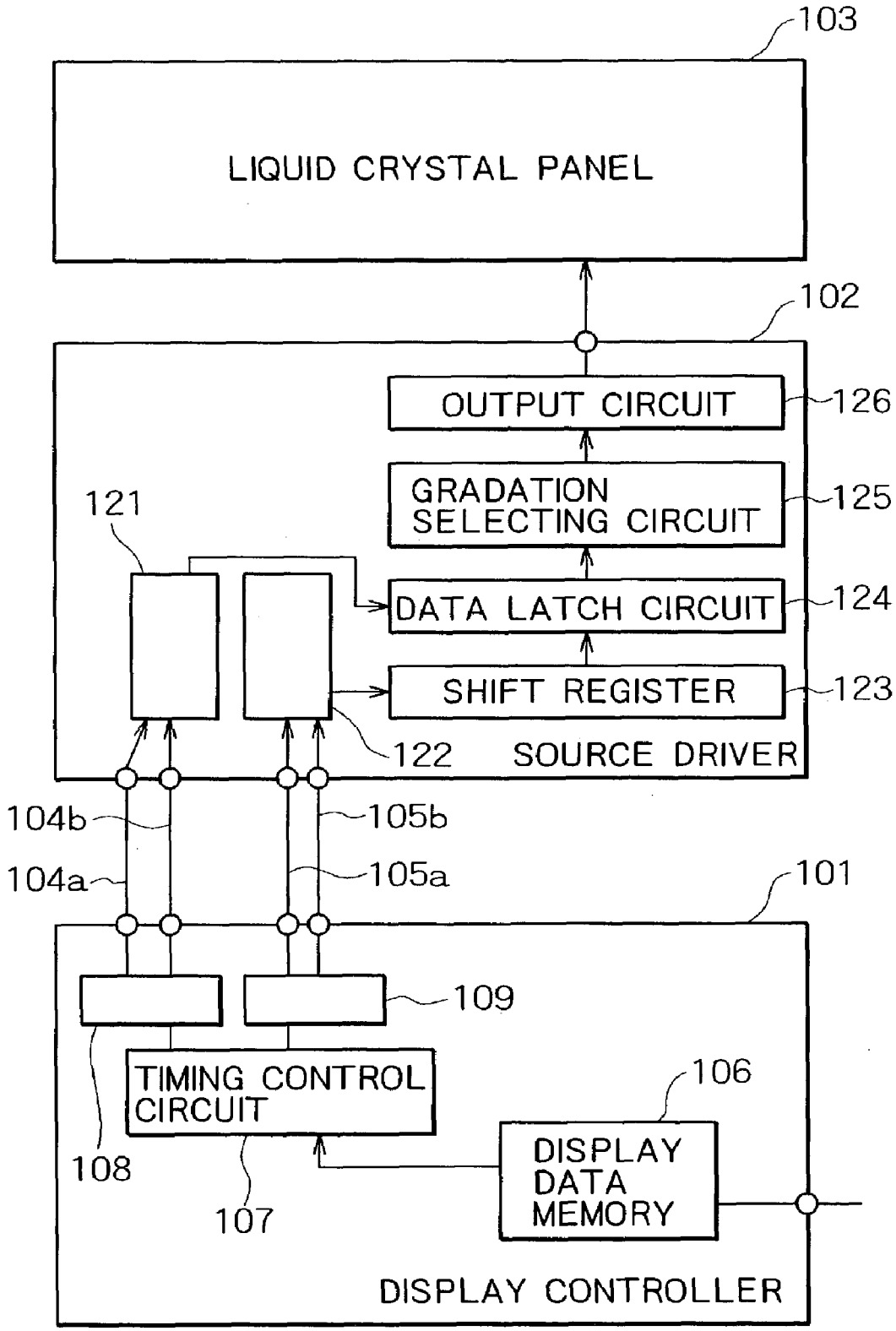
FIG. 1 PRIOR ART
FIG. 1 is a block diagram showing a conventional liquid crystal display device to which CMADS is applied.
Figure 2:
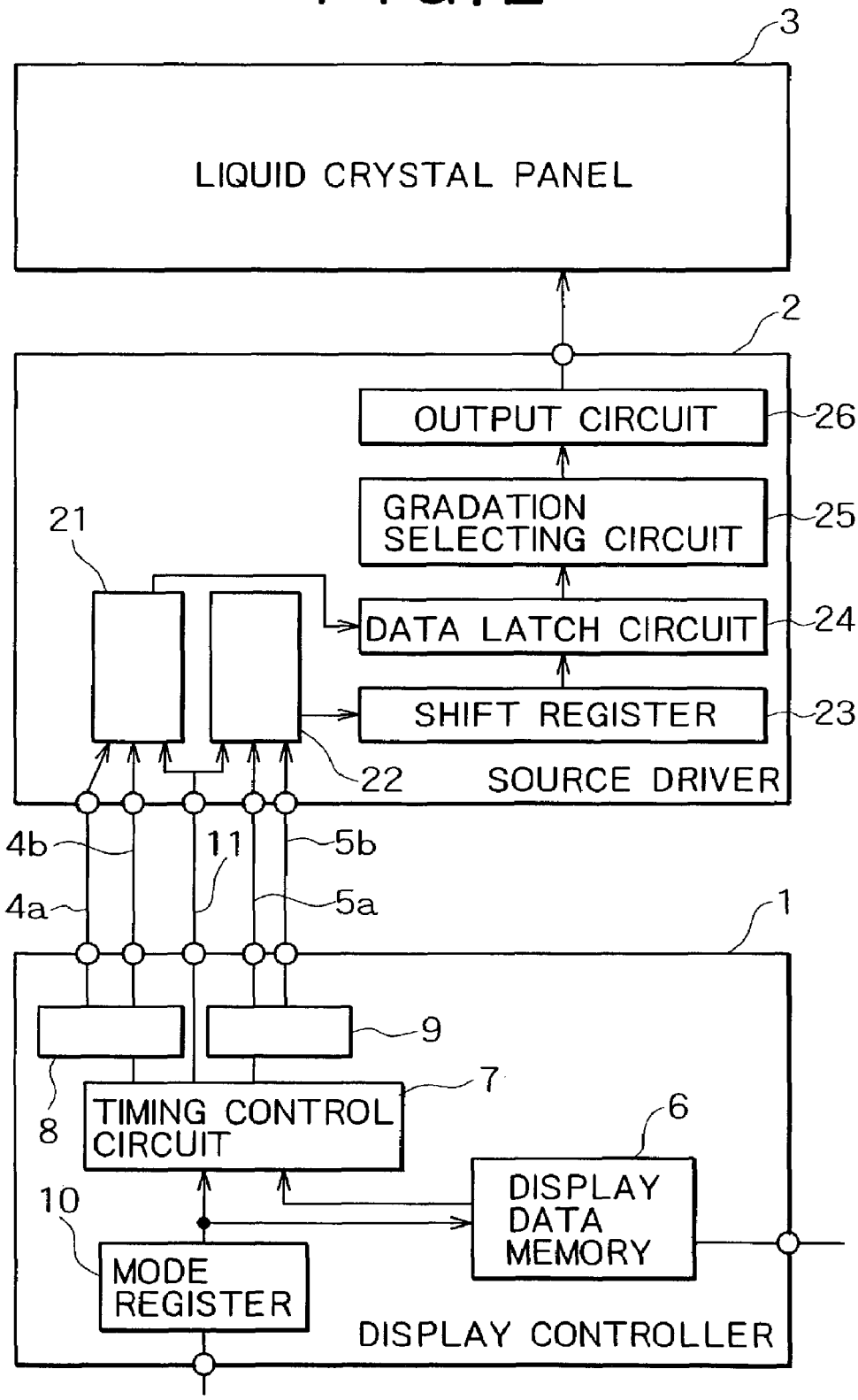
FIG. 2 is a block diagram showing a liquid crystal display device according to a first embodiment of the present invention.
Figure 3:
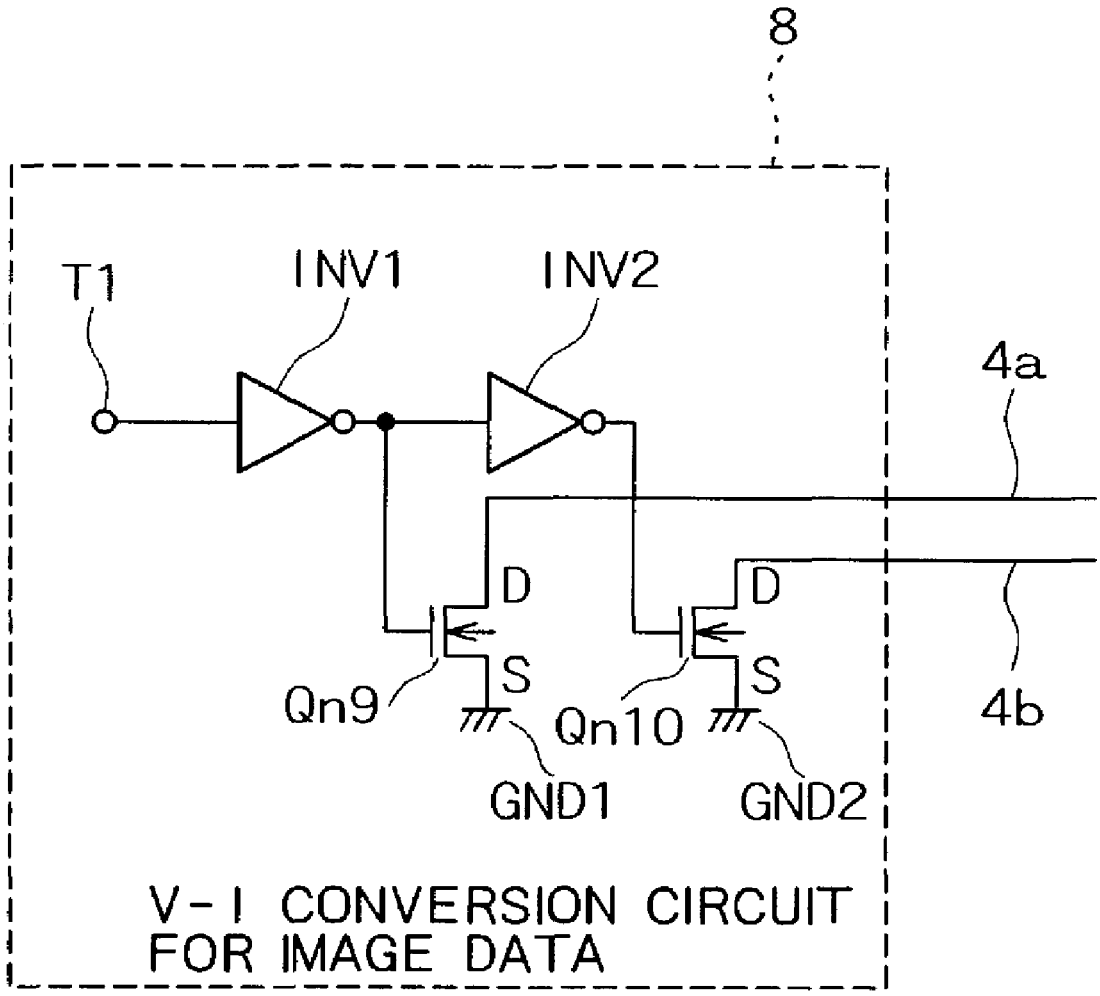
FIG. 3 is a circuit diagram showing a V-I conversion circuit for image data of the liquid crystal display device shown in FIG. 2.
Figure 4:
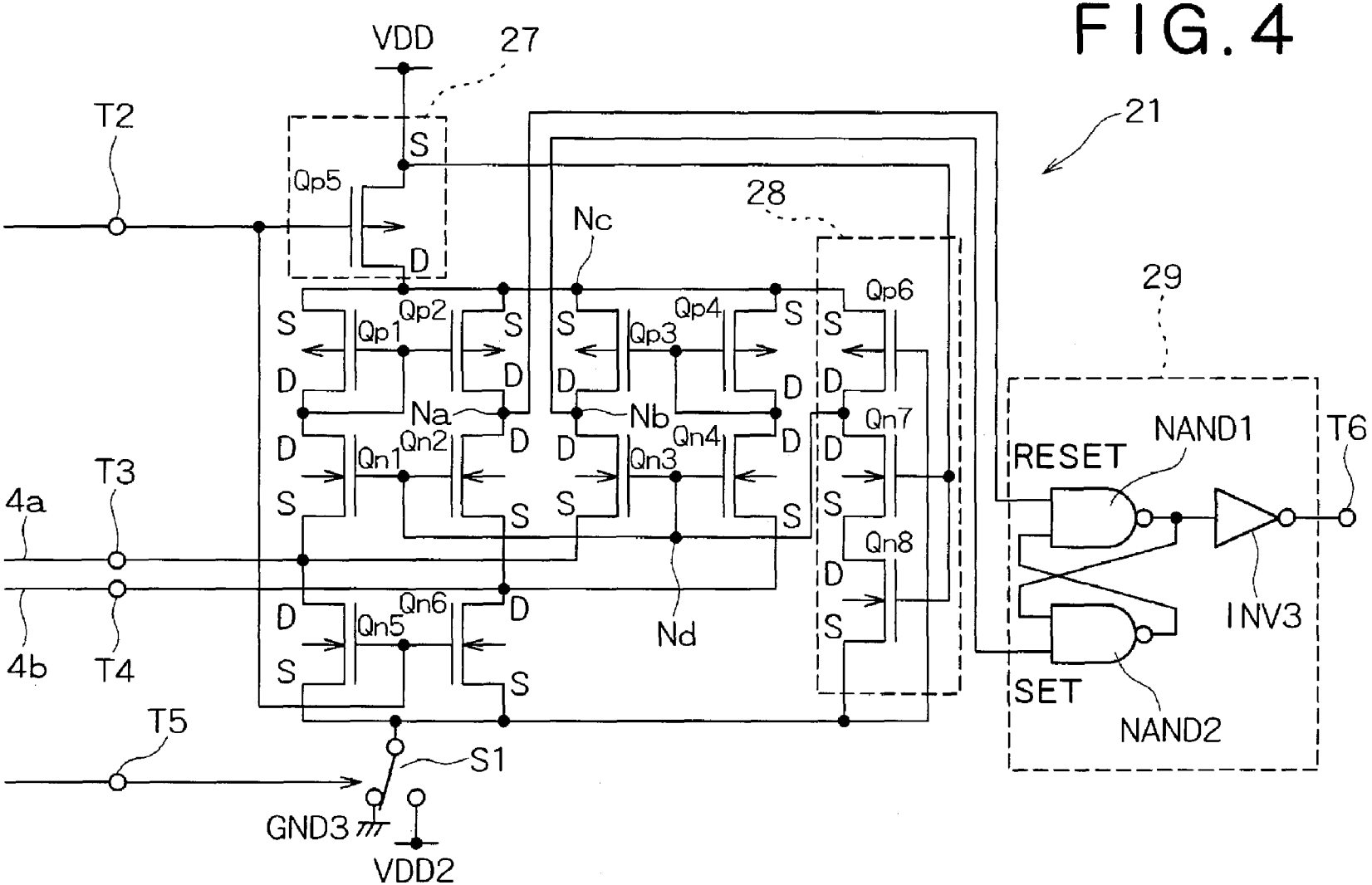
FIG. 4 is a circuit diagram showing an I-V conversion circuit for image data of the liquid crystal display device shown in FIG. 2.

The preferred embodiments of the present invention will be specifically described with reference to the accompanying drawings. The first embodiment of the present invention will be described first. FIG. 2 is the block diagram showing the liquid crystal display device according to the embodiment, FIG. 3 is the circuit diagram showing the V-I conversion circuit for image data of the liquid crystal display device shown in FIG. 2, and FIG. 4 is the circuit diagram showing the I-V conversion circuit for image data of the liquid crystal display device shown in FIG. 2. The liquid crystal display device according to the embodiment is the liquid crystal display device to which the CMADS is applied.

As shown in FIG. 2, the liquid crystal display device according to the embodiment is provided with a display controller 1, a source driver 2, and a liquid crystal panel 3. Further, two pairs of wirings 4*a* and 4*b*, 5*a* and 5*b* are provided between the display controller 1 and the source driver 2, and a wiring 11 is further provided. Note that the number of the source driver 2 depends on the size of the liquid crystal panel 3 and the performance of the source driver 2. For example, 1 source driver is provided for the display device including a small liquid crystal panel such as a cellular phone, and approximately 10 to 12 source drivers are provided for a large display, for example.

The display controller 1 is one to which the image data as digital two-value voltage signal is input from outside and that outputs the image data by every line of an image. The display controller 1 is provided with a display data memory 6, a timing control circuit 7, a V-I conversion circuit for image data 8, a V-I conversion circuit for clock signal 9, and a mode register 10. The display data memory 6 is one to which the image data is input from outside and that holds the image data of a certain amount that is the image data for one screen, for example. The mode register 10 is one to which data regarding the display mode of an image such as the subtractive color mode is input, for example, and that outputs the control signal to the display data memory 6 and the timing control circuit 7 in response to the display mode. Input terminals are provided for the display data memory 6 and the mode register 10.

The timing control circuit 7 reads out the image data for a certain amount, that is, the image data equivalent to one line from the display data memory 6 based on the control signal output from the mode register 10, outputs the clock signal to the V-I conversion circuit for clock signal 9, sequentially outputs the image data equivalent to one line to the V-I conversion circuit for image data 8 based on the control signal synchronously with the clock signal, and further outputs the receiver control signal, which shows whether the clock signal and the image data are being output or not, to the source driver 2 via the wiring 11. Further, the timing control circuit 7 outputs a signal STH that activates the source driver 2. The signal STH is transmitted to the source driver 2 via a wiring (not shown).

As shown in FIG. 3, the V-I conversion circuit for image data 8 is provided with an input terminal T1, two inverters INV1, INV2, two N-channel type MOS transistors Qn9, Qn10, and earth electrodes GND1, GND2. The input terminal of the inverter INV1 is connected to the input terminal T1, and the output terminal is connected to the input terminal of the inverter INV2 and the gate of the transistor Qn9. The output terminal of the inverter INV2 is connected to the gate of the transistor Qn10. Further, the drain and the source of the transistor Qn9 are connected to the wiring 4*a* and the earth electrode GND1 respectively, and the drain and the source of the transistor Qn10 are connected to the wiring 4*b* and the earth electrode GND2 respectively. The V-I conversion circuit for image data 8 is an image data switching circuit.

The configuration of the V-I conversion circuit for clock signal 9 is the same as the configuration of the V-I conversion circuit for image data 8, which is connected to one end of a pair of the wirings 5*a*, 5*b*, and either one of a pair of the wirings 5*a*, 5*b* is connected to an earth electrode (not shown) and the other one is set to the floating state based on the clock signal.

The source driver 2 is provided with an I-V conversion circuit for image data 21, an I-V conversion circuit for clock signal 22, a shift register 23, a data latch circuit 24, a gradation selecting circuit 25, and an output circuit 26.

As shown in FIG. 4, the I-V conversion circuit for image data 21 is provided with a bias terminal T2, an input terminal T3 connected to the wiring 4*a*, an input terminal T4 connected to the wiring 4*b*, an input terminal T5 connected to the wiring 11, and an output terminal T6. Further, the I-V conversion circuit for image data 21 is provided with P-channel type MOS transistors Qp1 to Qp6, N-channel type MOS transistors Qn1 to Qn8, NAND gates with two outputs NAND1, NAND2, and an inverter INV3. The transistor Qp5 constitutes a current detecting section 27, the transistors Qp6, Qp7, Qp8 constitute a potential control section 28, the transistors Qp1, Qn1, Qp3, Qn3 constitute a first current supply section, and the transistors Qp2, Qn2, Qp4, Qn4 constitute a second current supply section. Each of the transistors Qp1 to Qp4 constitutes a constant current source, and each of the transistors Qn1 to Qn4 constitutes a switching transistor. In other words, a pair of the constant current source and switching transistor is provided for each current supply source. Further, NAND gates NAND1, NAND2 and the inverter INV3 constitute an RS latch circuit 29.

The source of the transistor Qp5 and the gates of the transistors Qn7, Qn8 are connected to a power source electrode VDD1. The gates of the transistors Qp5, Qn5, Qn6 are connected to the bias terminal T2. The drain of the transistor Qp5 and the sources of the transistors Qp1 to Qp4, Qp6 are connected to a node Nc.

The sources of the transistors Qn5, Qn6, Q8 and the gate of the transistor Qp6 are connected to a switch Si, and the switch S1 is designed to be connected to an earth electrode GND3 or a power source electrode VDD2. Specifically, the switch S1 is designed to select whether the source of the transistor Qn8 is made to connect to the earth electrode GND3 or to the power source electrode VDD2 by the receiver control signal entered via the wiring 11 and the input terminal T5. By connecting the source of the transistor Qn8 to the earth electrode GND3, the first current supply section and the second current supply section operate, and the electric current is allowed to flow either to the first current supply section or the second current supply section. By connecting the source of the transistor Qn8 to the power source electrode VDD2, the operation of the first current supply section and the second current supply section stops, and the electric current is not allowed to flow both to the first and second current supply sections. Note that there exists another method to stop the operation of the first and second current supply sections. For example, a node Nd may be connected to the earth electrode, or the bias terminal T2 may be connected to the power source electrode.

The drains of the transistors Qp1, Qn1 are connected to the gates of the transistors Qp1, Qp2. The gates of the transistors Qn1 to Qn4 and the drains of the transistors Qp6, Qp7 are connected to the node Nd. The sources of the transistors Qn1, Qn3 and the drains of the transistor Qn5 are connected to the input terminal T3. The sources of the transistors Qn2, Qn4 and the drains of the transistor Qn6 are connected to the input terminal T4. The drains of the transistors Qp2, Qn2 and one input terminal of the NAND gate NAND1 that is a reset input of the RS latch circuit 29 are connected to a node Na.

The drains of the transistors Qp3, Qn3 and one input terminal of the NAND gate NAND2 that is a set input of the RS latch circuit 29 are connected to a node Nb. The drains of the transistors Qp4, Qn4 are connected to the gates of the transistors Qp3, Qp4. The source of the transistor Qn7 is connected to the drain of the transistor Qp8. The output terminal of the NAND gate NAND1 is connected to the other input terminal of the NAND gate NAND2 and the input terminal of the inverter INV3, and the output terminal of the NAND gate NAND2 is connected to the other input terminal of the NAND gate NAND1. The output terminal of the inverter INV3 that is the output terminal of the RS latch circuit 29 is an output terminal T6 of the I-V conversion circuit for image data 21. Note that the potential of nodes Na, Nb, Nc, Nd are potential Va, Vb, Vc and Vd, respectively.

The configuration of the I-V conversion circuit for clock signal 22 shown in FIG. 2 is the same as the configuration of the I-V conversion circuit for image data 21, which is connected to a pair of the wirings 5*a*, 5*b* and the wiring 11.

The shift register 23 is one to which the clock signal is input from the I-V conversion circuit for clock signal 22 and that sequentially outputs the pulse signal from a plurality of output terminals (not shown) to the data latch circuit 24. The signal STH to start downloading the clock signal is also input to the shift register 23. The data latch circuit 24 downloads a plural image data from the I-V conversion circuit for image data 21 synchronously with the pulse signal to output simultaneously a plurality of the image data to the gradation selecting circuit 25. The gradation selecting circuit 25 is the D/A converter, which performs D/A conversion to the output signal from the data latch circuit 24 to generate the gradation signal that is an analog voltage signal and outputs the signal to the output circuit 26. The voltage of the gradation signal is the voltage applied for each pixel of the liquid crystal panel 3. The output circuit 26 performs current amplification to the gradation signal to generate the drive signal, and outputs the signal to each pixel of the liquid crystal panel 3.

Moreover, the liquid crystal panel 3 is provided with the two transparent substrates (not shown) arranged facing with each other, the liquid crystal layer (not shown) sandwiched between the transparent substrates, and the backlight (not shown) arranged behind the two transparent substrates. Further, the pixels (not shown) are arranged in a matrix state on the liquid crystal panel 3. Note that one pixel is formed by three cells of RBG (red, blue, green).

Figure 5:
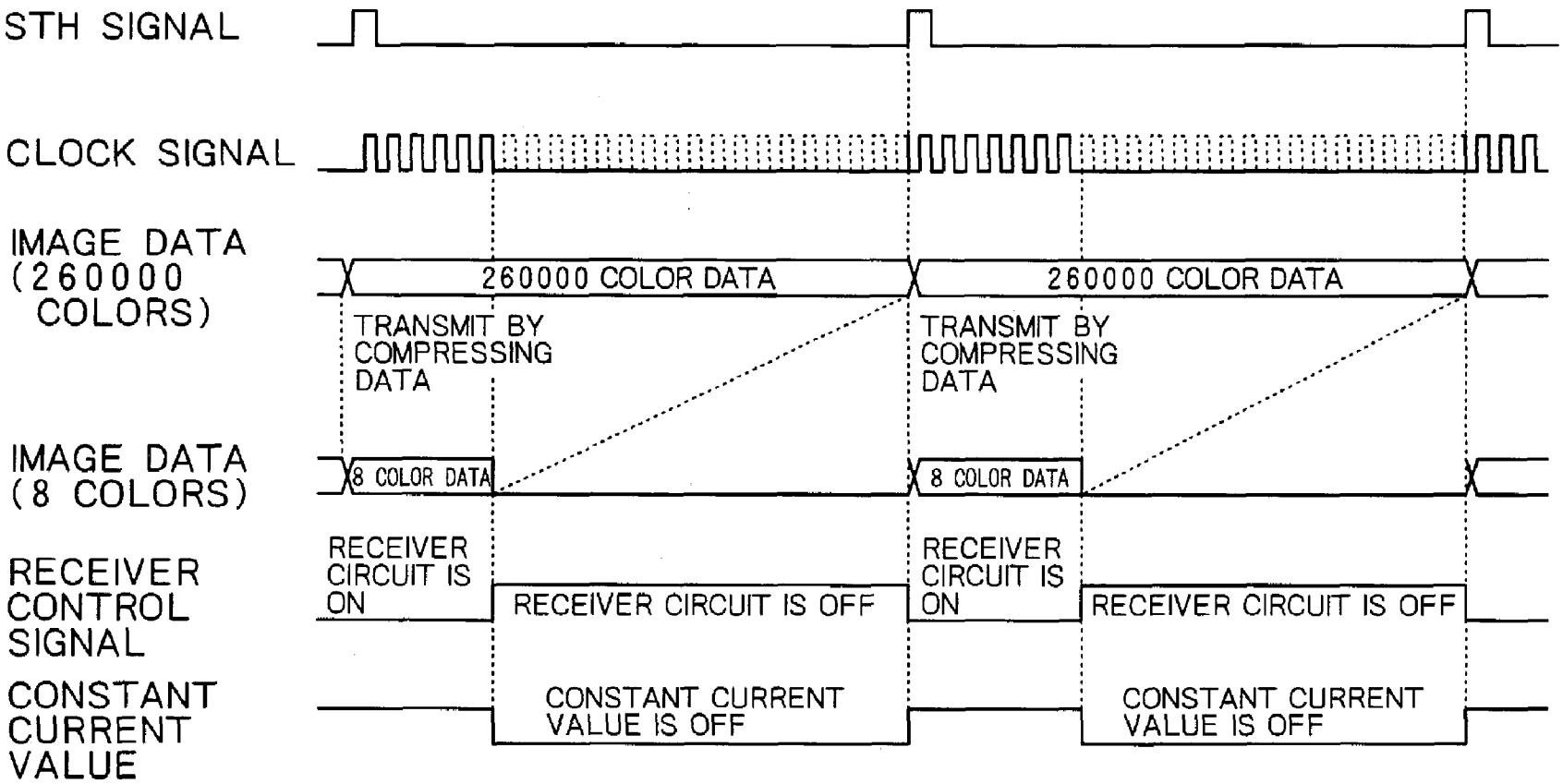
FIG. 5 is a timing chart showing the driving method of the liquid crystal display device according to the first embodiment.

Next, description will be made for the driving method of the liquid crystal display device according to the embodiment. FIG. 5 is the timing chart showing the driving method of the liquid crystal display device according to the embodiment, and FIG. 6 is the timing chart showing the operation of the V-I conversion circuit for image data 8 and the I-V conversion circuit for image data 21 of the liquid crystal display device according to the embodiment.

As shown in FIGS. 2 and 5, the image data as the two-valued voltage signal is input to the display data memory 6 of the display controller 1, and the display data memory 6 holds the image data equivalent to one screen, for example. Further, the signal showing the display mode of an image is input to the mode register 10, and the mode register 10 outputs the control signal to the display data memory 6 and the timing control circuit 7 in response to the display mode. Note that the display mode has a regular mode that shows an image in 260,000 colors and a subtractive color mode that shows an image in 8 colors, for example.

Next, the timing control circuit 7 reads out the image data equivalent to one line from the display data memory 6 based on the control signal output from the mode register 10, and outputs the clock signal that is the two-valued voltage signal to the V-I conversion circuit for clock signal 9. Further, the timing control circuit 7 sequentially outputs the image data to the V-I conversion circuit for image data 8 synchronously with the clock signal. The timing: control circuit 7 sequentially outputs the image data equivalent to 260,000 colors when the display mode is in the regular mode, outputs the image data equivalent to 8 colors in a lump, and stops outputting the clock signal and the image data during the remainder of the time when the display mode is the subtractive color mode of 8 colors, as shown in FIG. 5. Then, the timing control circuit 7 outputs the receiver control signal showing whether the clock signal and the image data are being output or not to the source driver 2 via the wiring 11. The receiver control signal is the two-valued voltage signal that is low (L) when the clock signal and the image data are output and is high (H) when they are not output, for example.

Figure 6:
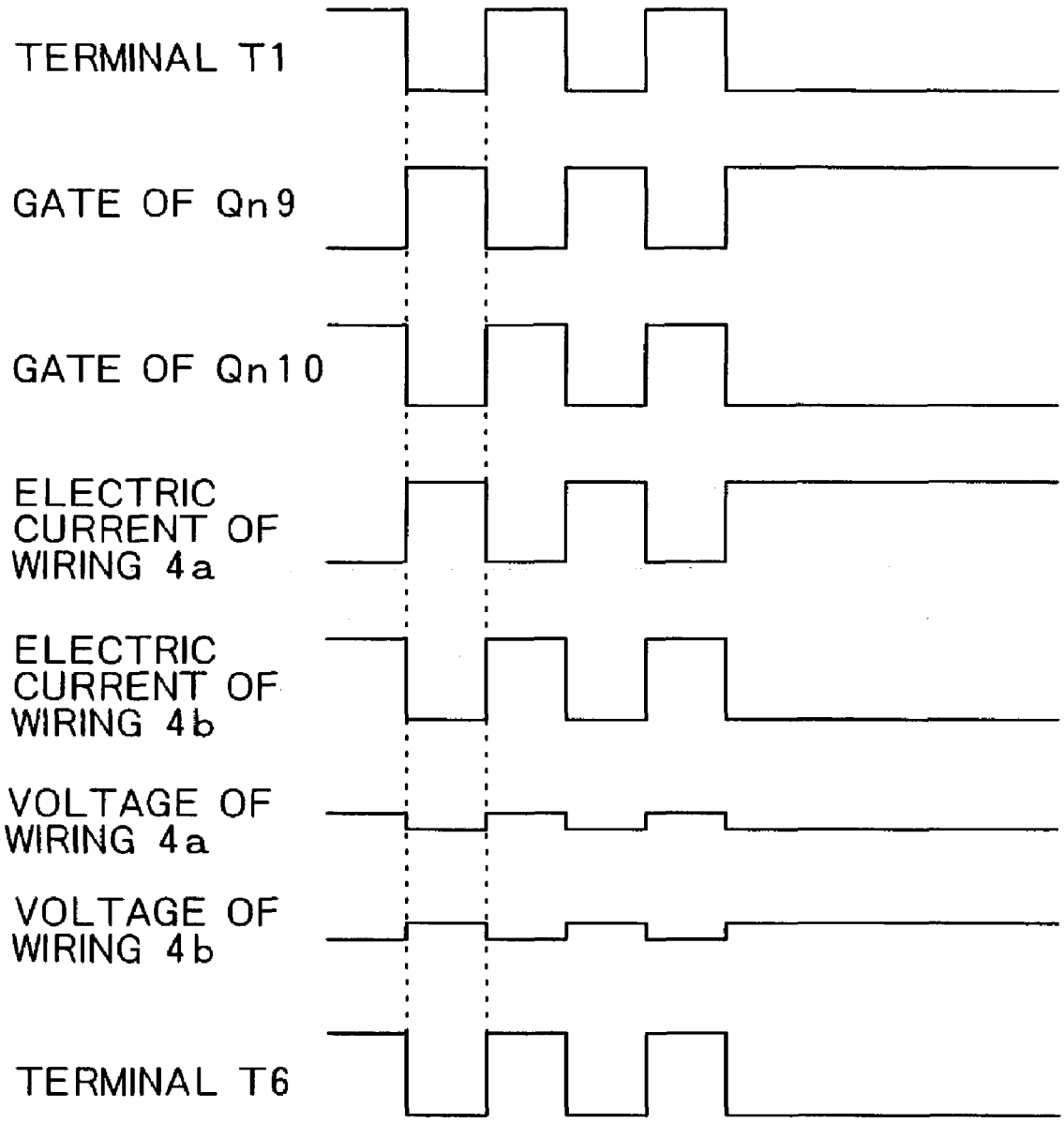
FIG. 6 is a timing chart showing the operation of the V-I conversion circuit for image data and the I-V conversion circuit for image data according to the first embodiment.

Next, as shown in FIGS. 3 and 6, the V-I conversion circuit for image data 8 connects one of a pair of the wirings 4*a*, 4*b* to the earth electrode and sets the other one to the floating state based on the image data entered from the timing control circuit 7. For example, when the image data input to the input terminal T1 is high, the output terminal of the inverter INV1 becomes low, the gate of the transistor Qn9 becomes low, and source-drain of the transistor Qn9 is turned off. Thus, the wiring 4*a* is set to the floating state. Further, the output terminal of the inverter INV2 becomes high, the gate of the transistor Qn10 becomes high, and the source-drain of the transistor Qn10 is turned on. Thus, the wiring 4*b* is connected to the earth electrode GND2. Similarly, when the image data is low, the wiring 4*a* is connected to the earth electrode GND1 and the wiring 4*b* is set to the floating state.

Furthermore, the V-I conversion circuit for clock signal 9 connects one of a pair of the wirings 5*a*, 5*b* to the earth electrode and sets the other one to the floating state based on the clock signal. The operation of the V-I conversion circuit for clock signal 9 is the same as the operation of the V-I conversion circuit for image data 8.

As shown in FIGS. 4 and 6, the switch S1 is connected to the earth electrode GND3 when the timing control circuit 7 outputs the clock signal and the image data, in the I-V conversion circuit for image data 21. Then, in the case where the image data is low, the wiring 4*a* is connected to the earth electrode GND1 to be the earth potential, and the wiring 4*b* is set to the floating state to be a floating potential, a gate-source voltage of the transistors Qn1, Qn3 becomes Vd to turn on, and thus exerting a current driving capability based on the voltage Vd. Consequently, the transistors Qp1, Qp3 allow the electric current to flow to the earth electrode GND1 of the V-I conversion circuit for image data 8 via the input terminal T3 and the wiring 4*a* by a constant current operation based on the voltage Vc. At this point, the voltage Vb becomes low. On the other hand, the electric current is not allowed to flow in the wiring 4*b*. Specifically, the first current supply section supplies the electric current to the wiring 4*a* and the second current supply section stops supplying the electric current to the wiring 4*b*. At this point, the potential of the wiring 4*a* becomes the earth potential, and the potential of the wiring 4*b* becomes a potential that is the floating potential and higher than the earth potential by approximately 100 to 200 mV.

Furthermore, the gate-source voltage of the transistors Qn2, Qn4 becomes zero to turn off. The potential Va of the transistors Qp2, Qp4 becomes high by the constant current operation. Thus, the set input and the reset input of the RS latch circuit 29 become high and low, respectively.

A bias voltage Vs having a predetermined value is applied to the bias terminal T2. Accordingly, the gate-source voltage of the transistors Qp5, Qn5, Qn6 becomes Vs to turn on, and thus exerting the current driving capability based on the voltage Vs.

On the other hand, in the case where the image data is high, the wiring 4*a* is in the floating state to be the floating potential, and the wiring 4*b* is connected to the earth electrode GND2 to be the earth potential, the gate-source voltage of the transistors Qn1, Qn3 becomes zero to turn off. Further, the potential Vb of the transistors Qp1, Qp3 becomes high by the constant current operation. In addition, the gate-source voltage of the transistors Qp2, Qn4 becomes Vd to turn on, and thus exerting the current driving capability based on the voltage Vd. Consequently, the transistors Qp2, Qp4 allow the electric current to flow to the earth electrode GND2 of the V-I conversion circuit for image data 8 via the input terminal T4 and the wiring 4*b* by the constant current operation based on the voltage Vc. On the other hand, the electric current is not allowed to flow in the wiring 4*a*. Specifically, the first current supply section stops supplying the electric current to the wiring 4*a* and the second current supply section supplies the electric current to the wiring 4*b*. At this point, the potential of the wiring 4*b* becomes the earth potential, and the potential of the wiring 4*a* becomes the potential that is the floating potential and higher than the earth potential by approximately 100 to 200 mV. Further, the voltage Va becomes low. Thus, set input and the reset input of the RS latch circuit 29 become low and high, respectively.

As described above, by allowing the electric current to flow in the wiring 4*a* or 4*b* based on the image data, the complementary current signal based on the image data is generated in a pair of the wirings 4*a*, 4*b*. Consequently, the image data that is the two-valued voltage signal, which has been input to the V-I conversion circuit for image data 8, is converted into the complementary current signal, and the current signal is transmitted from the V-I conversion circuit for image data 8 to the I-V conversion circuit for image data 21 via a pair of the wirings 4*a*, 4*b*. For example, when the image data is high, the electric current is not allowed to flow in the wiring 4*a* but allowed to flow in the wiring 4*b*. Further, when the image data is low, the electric current is allowed to flow in the wiring 4*a* but not allowed to flow in the wiring 4*b*.

Furthermore, the RS latch circuit 29 determines a value to be held when the set input or the reset input changes from a high level to a low level. The value of the output terminal T6 becomes high when the set input changes from low to high, and the value of the output terminal T6 becomes low when the reset input changes from low to high. As a result, the I-V conversion circuit for image data 21 converts the current signal flowing in a pair of the wirings 4*a*, 4*b* into the two-valued voltage signal, and thus regenerating the image data. Then, the circuit 21 outputs the regenerated image data to the data latch circuit 24.

When the timing control circuit 7 does not output the clock signal and the image data, the switch S1 is connected to the power source electrode VDD2. This makes the first and second current supply sections stop their functions, and does not allow the electric current to flow in the both wirings 4*a*, 4*b*.

Note that a necessary current amount is determined when the frequency of the image data to be transmitted is determined. The current detecting section 27 controls the current amount based on the bias signal entered via the bias terminal T2.

By an operation similar to that of the I-V conversion circuit for image data 21, the I-V conversion circuit for clock signal 22 allows the electric current to flow in the wiring out of a pair of the wirings 5*a*, 5*b*, which is connected to the earth electrode. On the other hand, the electric current is not allowed to flow in the wiring in the floating state. As a result, the clock signal that is the voltage signal is converted into a pair of complementary current signals, and the V-I conversion circuit for clock signal 9 transmits the current signal to the I-V conversion circuit for clock signal 22. Then, the I-V conversion circuit for clock signal 22 converts the current signal into the two-valued voltage signal again to regenerate the clock signal, and outputs the clock signal to the shift register 23. Note that the I-V conversion circuit for clock signal 22 does not allow the electric current to flow in the both wirings 5*a*, 5*b* when the timing control circuit 7 does not output the clock signal and the image data.

The shift register 23 downloads the clock signal from the I-V conversion circuit for clock signal 22, and sequentially outputs the pulse signal from a plurality of output terminals to the data latch circuit 24. Then, the data latch circuit 24 downloads a plurality of image data from the I-V conversion circuit for image data 21 synchronously with the pulse signal, and simultaneously outputs a plurality of the image data to the gradation selecting circuit 25. Next, the gradation selecting circuit 25 performs D/A conversion to the output signal to generate the gradation signal that is the analog voltage signal, and outputs the signal to the output circuit 26. Next, the output circuit 26 performs current amplification to the gradation signal to generate the drive signal, and applies it to each pixel of the liquid crystal panel 3.

On the other hand, in the liquid crystal panel 3, the backlight irradiates light to each pixel. Thus, the liquid crystal layer of each pixel changes transmission factor of light according to the voltage of the drive signal, forms an image as the entire liquid crystal panel 3.

In the embodiment, transmission of the image data and the clock signal between the display controller 1 and the source driver 2 is performed by the current signal. This restricts the affect of the parasitic capacitance of the wiring, and the high-speed transmission of the signal can be realized. As a result, although a conventional voltage transmission method has required 18 wirings in order to transmit the image data of 18 bits, for example, and 19 wirings have been required in total including one wiring for transmitting the clock signal, the transmission of the image data and the clock signal can be performed in high-speed according to the embodiment. Accordingly, it is possible to transmit the image data and the clock signal only by 4 wirings in total including a pair of wirings for transmitting image data and a pair of wirings for transmitting clock signal. As a result, the number of wirings can be reduced and a circuit section of the liquid crystal display device can be manufactured in a smaller size.

Further, as described above, since the amplitude of voltage is as small as approximately 100 to 200 mV in the wiring pairs 4*a* and 4*b*, 5*a* and 5*b*, noise in transmitting signal is small. Moreover, since the current power source is not provided for a transmitter, that is, the display controller 1, but for a receiver, that is, the source driver 2, it is not necessary to change the specification of the display controller even if the number of the source driver 2 changes, and the design of the display controller is easy.

Still further, in the embodiment, the display controller 1 is provided with the mode register 10 and the timing control circuit 7 outputs the receiver control signal showing whether the image data and the clock signal are being output or not, so that the I-V conversion circuit for image data 21 and the I-V conversion circuit for clock signal 22 stop allowing the electric current to flow in the wirings 4*a* and 4*b* and the wirings 5*a* and 5*b* when the image data and the clock signal are not output. Thus, in adopting the display mode with small image data such as the subtractive color mode, it is possible to stop allowing the electric current to flow in the wirings during a period when the image data is not transmitted. As a result, reduction of the power consumption can be achieved.

Figure 7:
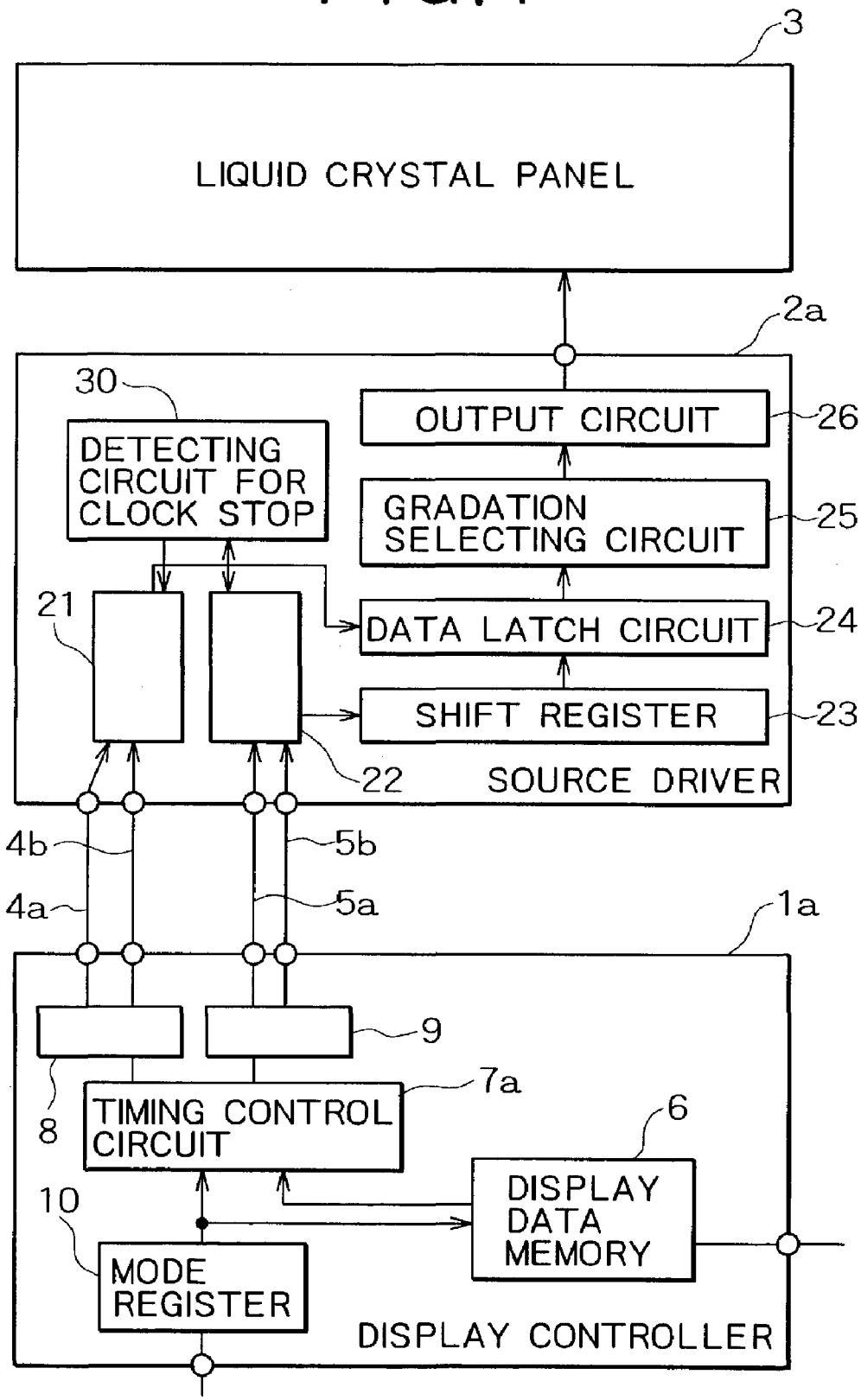
FIG. 7 is a block diagram showing the liquid crystal display device according to a second embodiment of the present invention.

Next, the second embodiment of the present invention will be described. FIG. 7 is the block diagram showing the liquid crystal display device according to the embodiment. As shown in FIG. 7, in the liquid crystal display device according to the embodiment, a display controller 1*a* is provided with a timing control circuit 7*a* instead of the timing control circuit 7, and a source driver 2*a* is provided with a CLK stop detecting circuit 30, comparing with the above-described liquid crystal display device according to the first embodiment (refer to FIG. 2). Further, the wiring 11 is not provided. The configuration of the liquid crystal display device of the embodiment other than the one described above is the same as the configuration of the liquid crystal display device of the first embodiment described above.

What the timing control circuit 7*a* is different from the timing control circuit 7 of the first embodiment is that the circuit 7*a* does not output the receiver control signal. The configuration and the operation other than this is the same-as the timing control circuit 7. Further, the CLK stop detecting circuit 30 is connected to the I-V conversion circuit for clock signal 22, detects whether the current signal based on the clock signal has been input to the I-V conversion circuit for clock signal 22 or not, and outputs the result as the receiver control signal to the I-V conversion circuit for image data 21 and the I-V conversion circuit for clock signal 22. Then, when the current signal based on the clock signal has not been input to the I-V conversion circuit for clock signal 22, the I-V conversion circuit for image data 21 stops allowing the electric current to flow in the wirings 4*a*, 4*b*.

Figure 8:
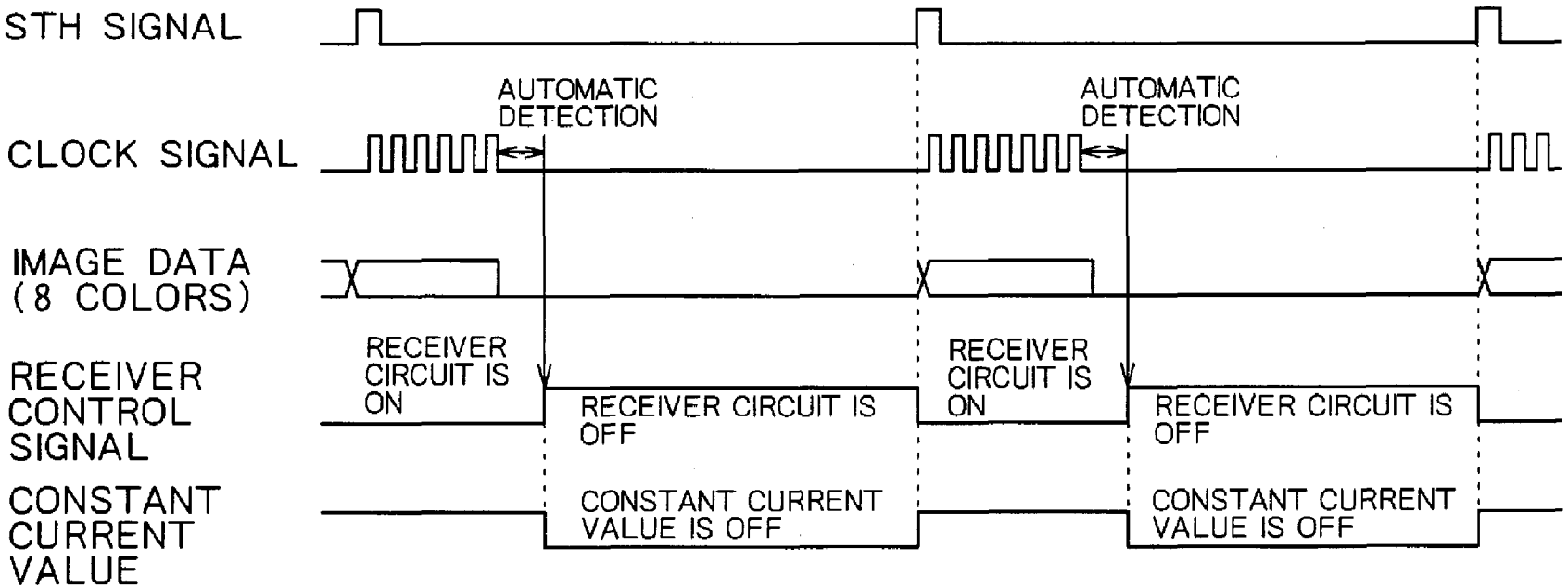
FIG. 8 is a timing chart showing the driving method of the liquid crystal display device according to the second embodiment.

Next, description will be made for the driving method of the liquid crystal display device according to the embodiment. FIG. 8 is the timing chart showing the driving method of the liquid crystal display device of the embodiment. Note that detailed description will be omitted for the area of the driving method of the embodiment, which is the same as the driving method of the above-described first embodiment.

Firstly, as shown in FIGS. 7 and 8, the display data memory 6 holds the image data that is the two-valued voltage signal in the same manner as the above-described first embodiment. Further, the mode register 10 outputs the control signal to the display data memory 6 and the timing control circuit 7*a* according to the display mode.

Next, the timing control circuit 7*a* reads out the image data equivalent to one line from the display data memory 6 based on the control signal, and outputs the clock signal that is the two-valued voltage signal to the V-I conversion circuit for clock signal 9. In addition, the timing control circuit 7*a* sequentially outputs the image data to the V-I conversion circuit for image data 8 synchronously with the clock signal. At this point,-when the display mode is the subtractive color mode of 8 colors, for example, the circuit 7*a* outputs the image data equivalent to 8 colors in a lump, and stops outputting the clock signal and the image data during the remainder of the time, as shown in FIG. 8. Note that the timing control circuit 7*a* does not output the receiver control signal unlike the timing control circuit 7 of the first embodiment.

Next, the V-I conversion circuit for image data 8 connects one of a pair of the wirings 4*a*, 4*b* to the earth electrode and sets the other one to the floating state based on the image data entered from the timing control circuit 7*a*. Similarly, the V-I conversion circuit for clock signal 9 connects one of a pair of the wirings 5*a*, 5*b* to the earth electrode and sets the other one to the floating state based on the clock signal.

In the I-V conversion circuit for image data 21, the switch S1 is connected to the earth electrode GND3 when the timing control circuit 7*a* outputs the clock signal and the image data. Then, with the same operation as the above-described first embodiment, the circuit 21 allows the electric current to flow in the wiring out of the wirings 4*a*, 4*b*, which is connected to the earth electrode. Thus, the circuit 21 converts the image data that is the voltage signal into a pair of complementary current signals to receive them, and converts the current signal into the voltage signal again to regenerate the image data. Similarly, the I-V conversion circuit for clock signal 22 receives and regenerates the clock signal.

At this point, the CLK stop detecting circuit 30 detects whether the current signal based on the clock signal has been input to the I-V conversion circuit for clock signal 22, and outputs the result as the receiver control signal to the switch S1 (refer to FIG. 4) of the I-V conversion circuit for image data 21. Then, the switch S1 (refer to FIG. 4) of the I-V conversion circuit for image data 21 is switched to connect the source of the transistor Qn8 to the power source electrode VDD2 when the current signal has not been input to the I-V conversion circuit for clock signal 22. Accordingly, the I-V conversion circuit for image data 21 stops allowing the electric current to flow in the wirings 4*a*, 4*b*. Note that the I-V conversion circuit for clock signal 22 continues to allow the electric current to flow constantly in one of the wirings 5*a*, 5*b* in order to detect whether the current signal based on the clock signal has been input to the I-V conversion circuit for clock signal 22 or not.

The subsequent process is the same as the above-described embodiment. Specifically, the shift register 23 downloads the clock signal, the data latch circuit 24 downloads the image data, and outputs the image data to the gradation selecting circuit 25. Next, the gradation selecting circuit 25 performs D/A conversion to the output signal to generate the gradation signal that is the analog voltage signal, and outputs it to the output circuit 26. The output circuit 26 performs current amplification to the gradation signal to generate the drive signal and applies it to each pixel of the liquid crystal panel 3. Then, the liquid crystal panel 3 displays an image.

In the embodiment, a receiver, that is, the source driver 2*a* is provided with the CLK stop detecting circuit 30, and the CLK stop detecting circuit 30 determines whether the clock signal stops or not. Accordingly, it is unnecessary to transmit the receiver control signal between the display controller 1*a* and the source driver 2*a*. As a result, the embodiment has effects that wiring (equivalent to the wiring 11 shown in FIG. 2) for transmitting the receiver control signal is not required in addition to the effects of the above-described first embodiment.

Figure 9:
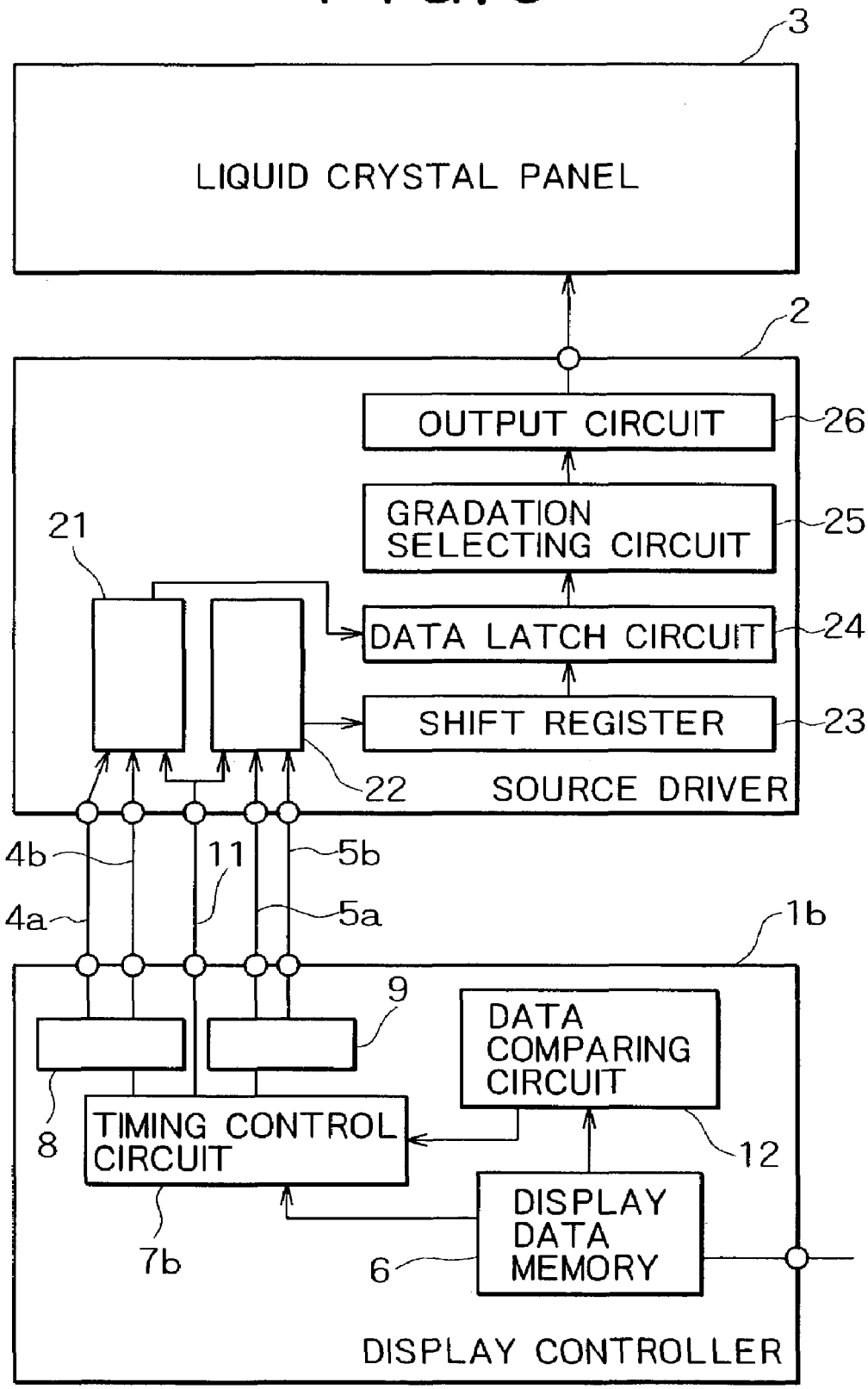
FIG. 9 is a block diagram showing the liquid crystal display device according to a third embodiment of the present invention.

Next, description will be made for the third embodiment. FIG. 9 is the block diagram showing the liquid crystal display device according to the embodiment. As shown in FIG. 9, in the liquid crystal display device according to the embodiment, a display controller 1*b* is provided with a timing control circuit 7*b* instead of the timing control circuit 7, and a data comparing circuit 12 is provided, comparing with the above-described liquid crystal display device according to the first embodiment (refer to FIG. 2). Further, the mode register is not provided. The configuration of the liquid crystal display device of the embodiment other than the one described above is the same as the configuration of the liquid crystal display device of the first embodiment described above.

The data comparing circuit 12 is connected to the display data memory 6 and the timing control circuit 7*b*, the timing control circuit 7*b* holds the image data read from the display-data memory 6, the data comparing circuit 12 compares the image data with image data that the timing control circuit 7*b* reads next from the display data memory 6, and outputs the result to the timing control circuit 7*b*. Further, what the timing control circuit 7*b* is different from the timing control circuit 7 of the first embodiment is that the output signal of the data comparing circuit 12 is input thereto and stops outputting the image data and the clock signal based on the input. The configuration and operation other than this are the same as those of the timing control circuit 7.

Figure 10:
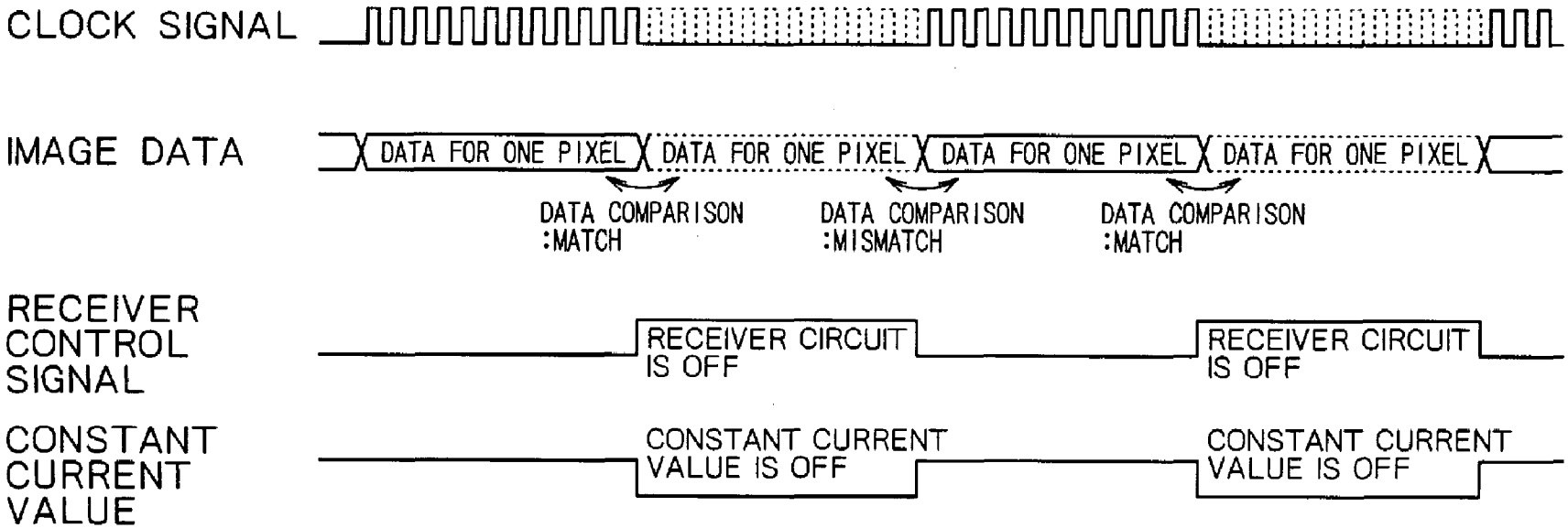
FIG. 10 is a timing chart showing the driving method of the liquid crystal display device according to the third embodiment.

Next, the driving method of the liquid crystal display device according to the embodiment will be described. FIG. 10 is the timing chart showing the driving method of the liquid crystal display device according to the embodiment. Note that detailed description will be omitted for the area of the driving method of the embodiment, which is the same as the driving method of the above-described first embodiment.

Firstly, as shown in FIGS. 9 and 10, the display data memory 6 holds the image data that is the two-valued voltage signal. Next, the timing control circuit 7*b* reads out a certain amount of the image data from the display data memory 6. At this point, the image data is also output to the data comparing circuit 12, and the data comparing circuit 12 stores the image data. Then, when the timing control circuit 7*b* reads out a certain amount of the image data from the display data memory 6 next, the data comparing circuit 12 compares the image data with the latest image data stored in the circuit 12, and outputs the result to the timing control circuit 7*b*. At this point, the data comparing circuit 12 compares the image data equivalent to one pixel, for example, with the image data of an adjacent pixel, and determines whether the data are equal to each other.

Subsequently, when the data comparing circuit 12 determines that the image data of the adjacent pixels are not equal to each other, the timing control circuit 7*b* outputs the clock signal to the V-I conversion circuit for clock signal 9, and sequentially outputs the image data to the V-I conversion circuit for image data 8 synchronously with the clock signal.

Further, when the data comparing circuit 12 determines that the image data of the adjacent pixels are equal to each other, the timing control circuit 7*b* stops outputting the clock signal and the image data. Furthermore, the timing control circuit 7*b* outputs the receiver control signal showing whether the clock signal and the image data are being output or not to the source driver 2 via the wiring 11.

The subsequent process is the same as the above-described first embodiment. Specifically, the V-I conversion circuit for image data 8 connects one of a pair of the wirings 4*a*, 4*b* to the earth electrode and sets the other one to the floating state based on the image data. Similarly, the V-I conversion circuit for clock signal 9 connects one of a pair of the wirings 5*a*, 5*b* to the earth electrode and sets the other one to the floating state based on the clock signal.

Then, the source driver 2 generates a pair of current signals based on the image data and a pair of current signals based on the clock signal. At this point, when the timing control circuit 7*b* does not output the image data and the clock signal based on the receiver control signal, the driver 2 stops generating the current signal. Then, the driver 2 generates the drive signal for the liquid crystal panel 3 based on the current signals and outputs them. Alternatively, when the generation of the current signal is stopped, the driver 2 outputs a drive signal same as the previous drive signal. Then, the liquid crystal panel 3 displays an image based on the drive signal. For example, assuming that one pixel consists of three display elements of RGB, data driving each display element are 6 bits and data equivalent to one pixel are 18 bits, the data latch circuit 24 latches the 18-bit data, the gradation selecting circuit 25 generates three analog signals from the 6-bit data for each of RGB, and the output circuit 26 drives the three display elements of RGB.

As described, in the embodiment, it is possible to compress pixel data and stop transmitting the image data when the image data are equal between adjacent pixels. Alternatively, generation of the current signal is stopped when the image data is not transmitted. Thus, in the case of displaying a uniform image such as an all-white display, the image data amount to be transmitted is reduced and the electric current is stopped when the image data is not transmitted, so that power consumption with the transmission of the image data can be restricted.

Note that the embodiment has shown an example where the image data between a pixel and another pixel, which are adjacent to each other, is compared, but the present invention is not limited to this. For example, image data of a pixel group that consists of a plurality of pixels may be compared with image data that consists of pixels of the same number as the pixel group and adjacent to the pixel group, or image data equivalent to one line may be compared with image data equivalent to the next one line adjacent to the line. Further, the embodiment has shown an example where the timing control circuit 7*b* stopped outputting the image data and the clock signal when the image data between the adjacent pixels are the same, but the present invention is not limited to this. For example, when image data of a pixel is equal to inverted image data of image data of an adjacent pixel, the timing control circuit 7*b* may stop outputting the image data and the clock signal. Thus, the image data amount can be reduced in the case of a black-and-white mode. Alternatively, the image data is encoded to compress the image data by another method, and the output of the image data and the clock signal may be stopped during the remainder of the time.

Figure 11:
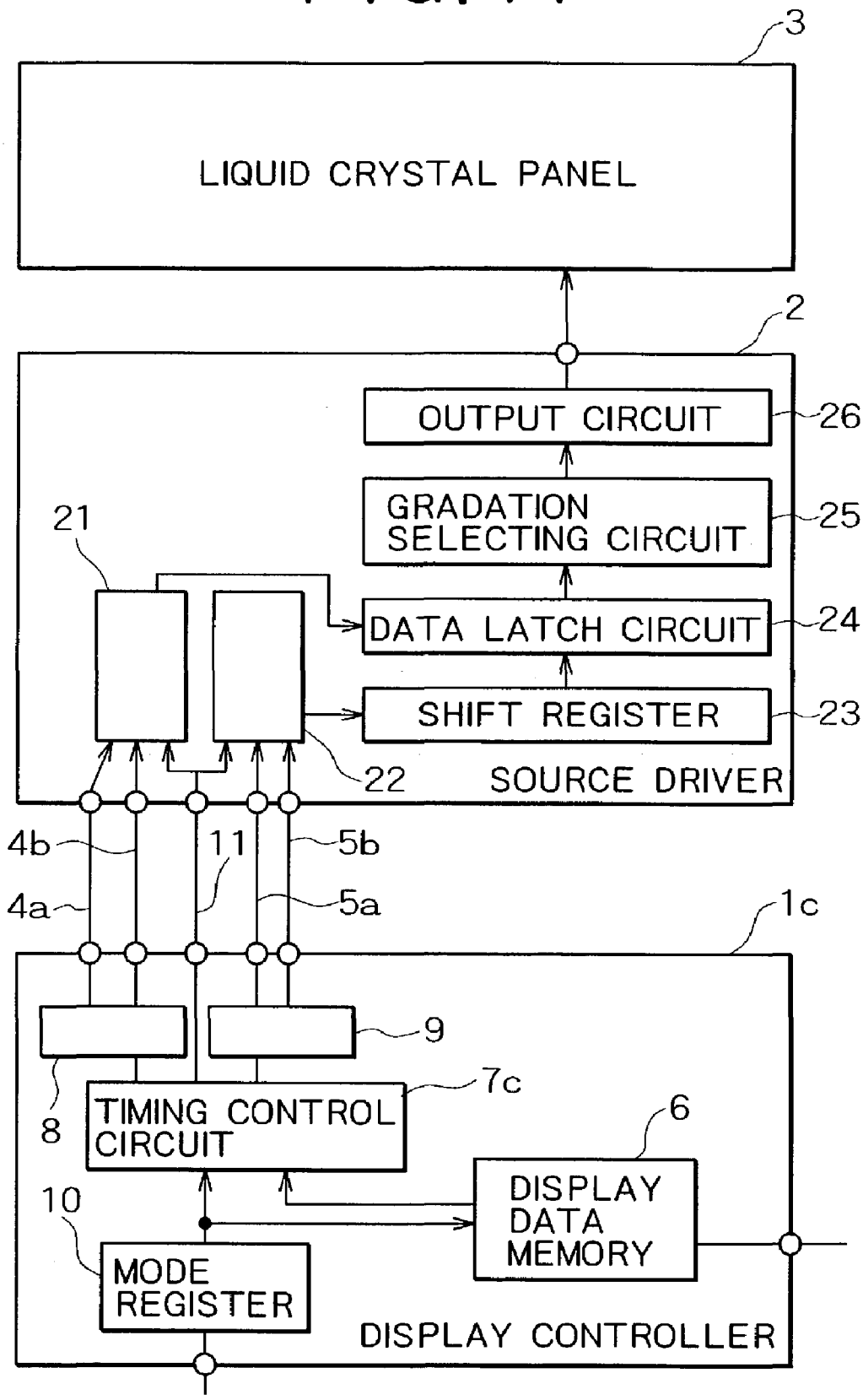
FIG. 11 is a block diagram showing the liquid crystal display device according to a fourth embodiment of the present invention.

Next, the fourth embodiment of the present invention will be described. FIG. 11 is the block diagram showing the liquid crystal display device according to the embodiment. As shown in FIG. 11, in the liquid crystal display device according to the embodiment, a display controller 1*c* is provided with a timing control circuit 7*c* instead of the timing control circuit 7, comparing with the above-described liquid crystal display device according to the first embodiment (refer to FIG. 2). Further, the receiver control signal output from the timing control circuit 7*c* is designed to be input to the bias terminal T2 (refer to FIG. 4) of the I-V conversion circuit for image data 21 and the bias terminal of the I-V conversion circuit for clock signal 22. The configuration of the liquid crystal display device of the embodiment other than the one described above is the same as the configuration of the liquid crystal display device of the first embodiment.

The timing control circuit 7*c* reads out a certain amount of the image data from the display data memory 6 based on the control signal output from the mode register 10, outputs the clock signal to the V-I conversion circuit for clock signal 9, and sequentially outputs a predetermined amount of image data to the V-I conversion circuit for image data 8 based on the control signal synchronously with the clock signal. At this point, the timing control circuit 7*c* adjusts the frequencies of the image data and the clock signal based on the control signal output from the mode register 10. Specifically, when the display mode is the subtractive color mode and has a smaller image data amount comparing with the regular mode, the circuit 7*c* reduces frequencies of the image data and the clock signal. Further, the timing control circuit 7*c* outputs the receiver control signal showing the frequencies of the image data and the clock signal to the source driver 2 via the wiring 11. Furthermore, the I-V conversion circuit for image data 21 and the I-V conversion circuit for clock signal 22 adjust the volume of the electric current allowed to flow in the wirings 4*a*, 4*b*, 5*a*, 5*b* based on the receiver control signal.

Figure 12:
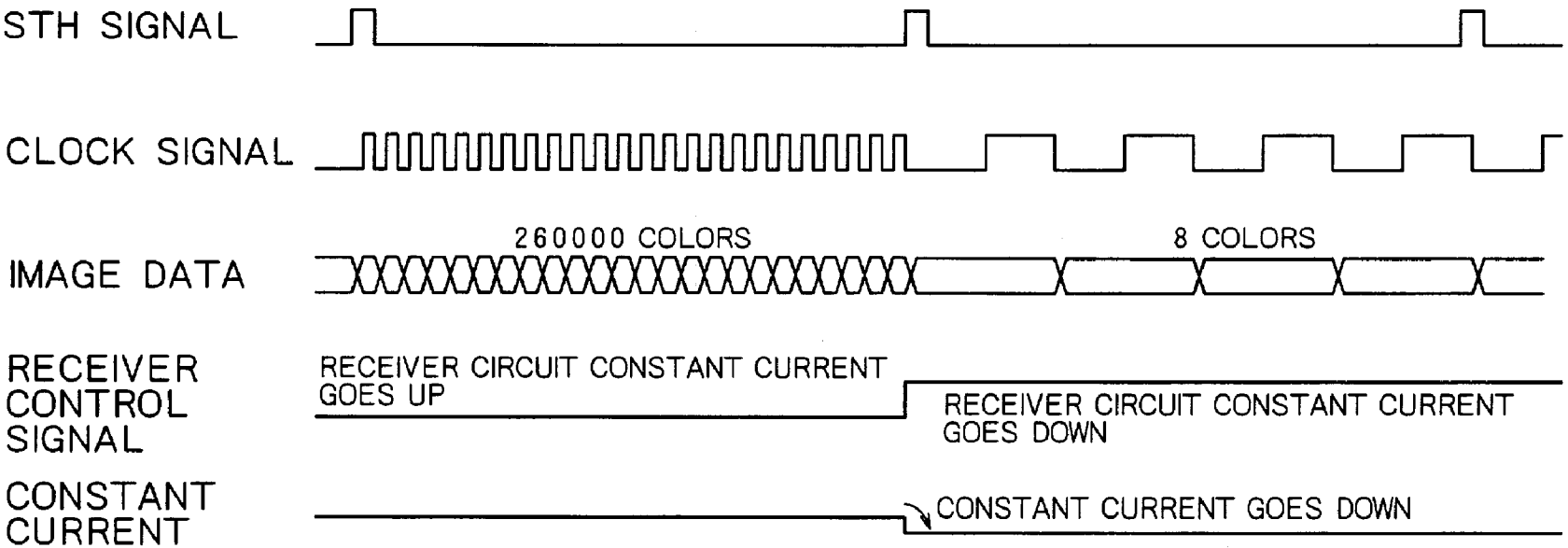
FIG. 12 is a timing chart showing the driving method of the liquid crystal display device according to the fourth embodiment.
Figure 13:
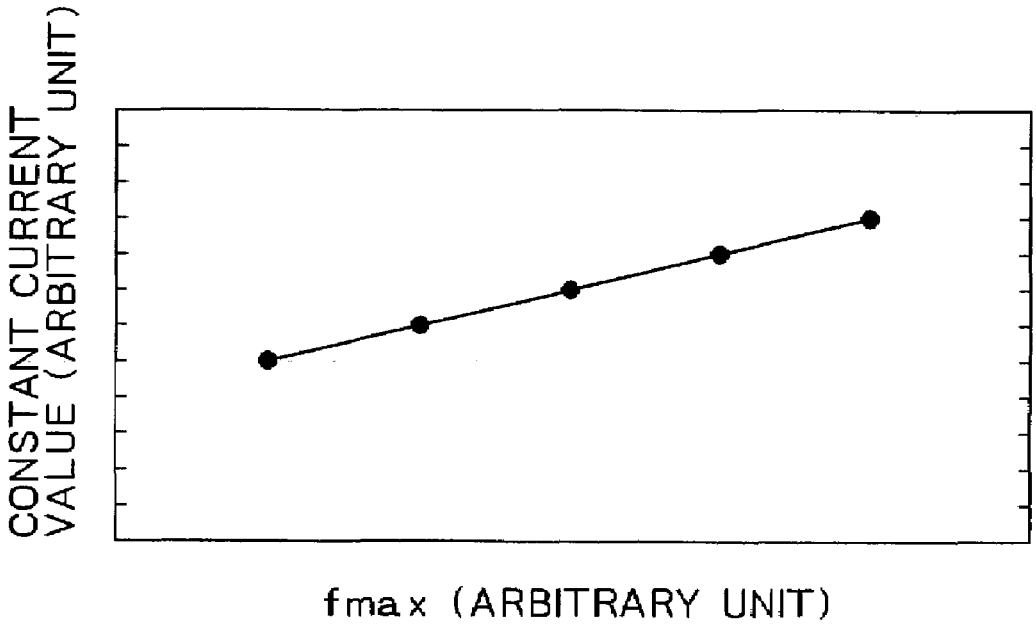
FIG. 13 is a graph showing the relationship between the maximum frequency of current signal and necessary current by setting the maximum frequency fmax of electric current to be transmitted to the axis of abscissas and a constant current value necessary for transmitting the current signal of the maximum frequency to the axis of ordinate.

Next, description will be made for the driving method of the liquid crystal display device according to the embodiment. FIG. 12 is the timing chart showing the driving method of the liquid crystal display device according to the embodiment, and FIG. 13 is the graph showing the relationship between the maximum frequency of the current signal and the necessary current by setting the maximum frequency fmax of electric current to be transmitted to the axis of abscissas and the constant current value necessary for transmitting the current signal of the maximum frequency to the axis of ordinate. Note that detailed description will be omitted for the area of the driving method of the embodiment, which is the same as the driving method of the above-described first embodiment.

Firstly, as shown in FIGS. 11 and 12, the display data memory 6 holds the image data that is the two-valued voltage signal in the same manner as the first embodiment described above. Further, the mode register 10 outputs the control signal to the display data memory 6 and the timing control circuit 7*c* according to the display mode.

Next, the timing control circuit 7*c* reads out a predetermined amount of the image data from the display data memory 6 based on the control signal, and outputs the clock signal to the V-I conversion circuit for clock signal 9. Further, the timing control circuit 7*c* sequentially outputs the image data to the V-I conversion circuit for image data 8 synchronously with the clock signal. At this point, the circuit 7*c* adjusts the frequencies of the image data and the clock signal according to the image data amount. Specifically, when the display mode is the subtractive color mode of 8 colors, for example, the circuit 7*c* reduces the frequencies so as to send the image data equivalent to 8 colors while making the best use of a transfer period, that is, to make residual time be the minimum.

Next, the V-I conversion circuit for image data 8 connects either one of a pair of the wirings 4*a*, 4*b* to the earth electrode and sets the other one to the floating state based on the image data entered from the timing control circuit 7*c*. Similarly, the V-I conversion circuit for clock signal 9 connects either one of a pair of the wirings 5*a*, 5*b* to the earth electrode and sets the other one to the floating state based on the clock signal.

In the I-V conversion circuit for image data 21, the switch S1 is fixed such that the source of the transistor Qn8 is constantly connected to the earth electrode GND3. Then, with the same operation as the above-described first embodiment, the circuit 21 allows the electric current to flow in the wiring out of the wirings 4*a*, 4*b*, which is connected to the earth electrode. Thus, the circuit 21 converts the image data that is the voltage signal into a pair of complementary current signals to receive them, and converts the current signal into the voltage signal again to regenerate the image data. Similarly, the I-V conversion circuit for clock signal 22 receives and regenerates the clock signal.

At this point, the frequencies of the image data and the clock signal fluctuate due to the amount of the image data transmitted, as shown in FIG. 12, and the frequencies reduce during the subtractive color mode, for example. As shown in FIG. 13, when the frequency of the current signal transmitted is low, the constant current value necessary for transmitting the current signal becomes low. In the embodiment, when the display mode is the mode having a small image data amount such as the subtractive color mode, the constant current values of the I-V conversion circuit for image data 21 and the I-V conversion circuit for clock signal 22 are reduced by the receiver control signal. For example, in the I-V conversion circuit for image data 21, the receiver control signal is input to the current detecting section 27 via the bias terminal T2. Thus, it is possible to adjust the constant current value of the I-V conversion circuit for image data 21. The subsequent process is the same as the above-described first embodiment.

In the embodiment, the timing control circuit 7*c* adjusts the frequencies of the image data and the clock signal according to the image data amount, and the I-V conversion circuit for image data 21 and the I-V conversion circuit for clock signal 22 adjust their constant current values based on the frequencies, so that the constant current values can be lowered in the case of a small image data amount. Consequently, the power consumption can be reduced.

Note that, in the embodiment, the image data amount may be reduced by encoding the image data as shown in the above described third embodiment.

Figure 14:
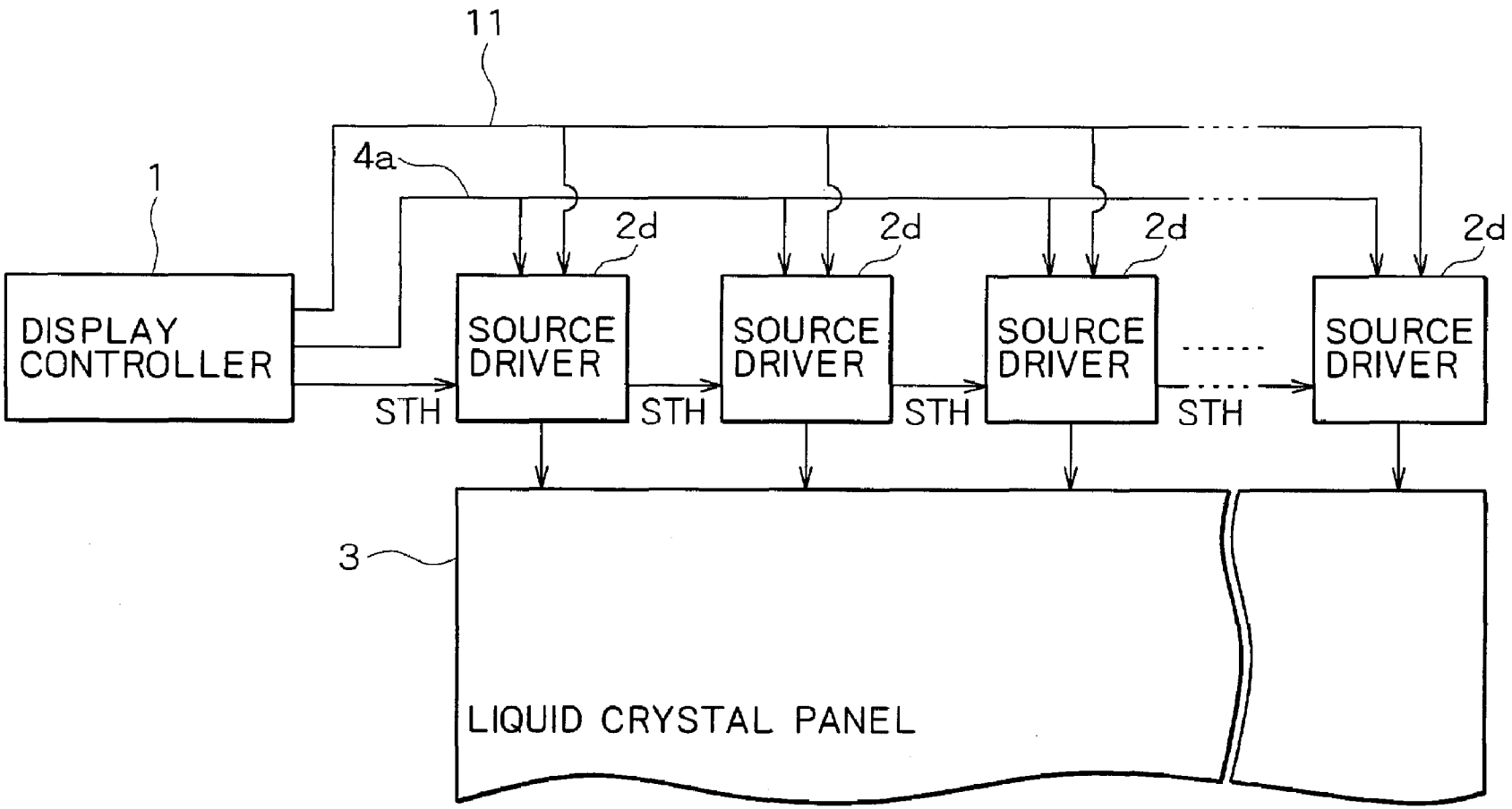
FIG. 14 is a block diagram showing the liquid crystal display device according to a fifth embodiment of the present invention.

Next, the fifth embodiment of the present invention will be described. FIG. 14 is the block diagram showing the liquid crystal display device according to the embodiment. As shown in FIG. 14, the embodiment shows an example where a plurality of source drivers 2*d* are provided in one liquid crystal display device. The applicant developed a technique to sequentially transmit the drive signal between receivers as a technique to efficiently drive a plurality of receivers and disclosed it in Japanese Patent Laid-open No.2002-026231. The embodiment is the example in which the technique and the present invention are combined. The liquid crystal display device according to the embodiment is provided with one display controller 1, a plurality of source drivers 2*d*, and one liquid crystal panel 3. Although the wirings 4*a*, 4*b*, 5*a*, 5*b*, 11 are provided between the display controller 1 and the source drivers 2*d*, FIG. 14 shows only the wirings 4*a*, 11 and the wirings 4*b*, 5*a*, 5*b* are omitted. Disposing positions of the wirings 4*b*, 5*a* and 5*b* are the same as that-of the wiring 4*a*. Each source driver 2*d* drives the pixel of columns of a part of the liquid crystal panel 3 to display an image. Then the display controller 1 outputs the image data, the clock signal and the receiver control signal parallelly to a plurality of the source drivers 2*d*. The display controller 1 also outputs the signal STH, which begins the operation of the shift register 23 (refer to FIG. 2), only to a source driver 2*d* arranged in the closest position to the display controller 1. Then, the source driver 2*d* to which the signal STH has been input is designed to output the signal STH to a source driver 2*d* arranged next to the source driver 2*d*. In this manner, the signal STH is to be sequentially input to all source drivers 2*d*. The configuration of the liquid crystal display device of the embodiment other than the one described above is the same as the configuration of the liquid crystal display device of the first embodiment described above.

Next, description will be made for the driving method of the liquid crystal display device according to the embodiment. With the similar method as the above-described first embodiment, the display controller 1 sets either one of the wirings 4*a*, 4*b* to the floating state and connects the other wiring to the earth electrode based on the image data. Further, the controller 1 sets either one of the wirings 5*a*, 5*b* to the floating state and connects the other wiring to the earth electrode based on the clock signal. Thus, the display controller 1 simultaneously outputs the image data and the clock signal to all the source drivers 2*d*.

The display controller 1 also outputs the signal STH to the source drivers 2*d*. Then, the source driver 2*d* to which the signal STH has been input starts an operation to display an image on a predetermined column of the liquid crystal panel 3 based on the image data input. At this point, the other source drivers 2*d* are in a stop state and do not drive the liquid crystal panel 3 even if the image data are entered.

When all necessary image data are input to this source driver 2*d*, the source driver 2*d* outputs the signal STH to another source driver 2*d* arranged next to the source driver 2*d*, and stops the operation. Consequently, the source driver 2*d* to which the signal STH has newly been input start an operation to drive the liquid crystal panel 3 based on the image data. Furthermore, the source driver 2*d* outputs the signal STH to the next source driver 2*d*, and stops the operation. In this manner, all source drivers 2*d* sequentially operate to drive the liquid crystal panel 3. As a result, an image is displayed as the entire liquid crystal panel 3. The operation of the embodiment other than the above-described ones is the same as the first embodiment described above.

In the embodiment, even if a plurality of source drivers are provided, the same image data is not downloaded into a plurality of source drivers and a right image can be displayed. The effects of the embodiment other than the above described ones are the same as the first embodiment described above.

Figure 15:
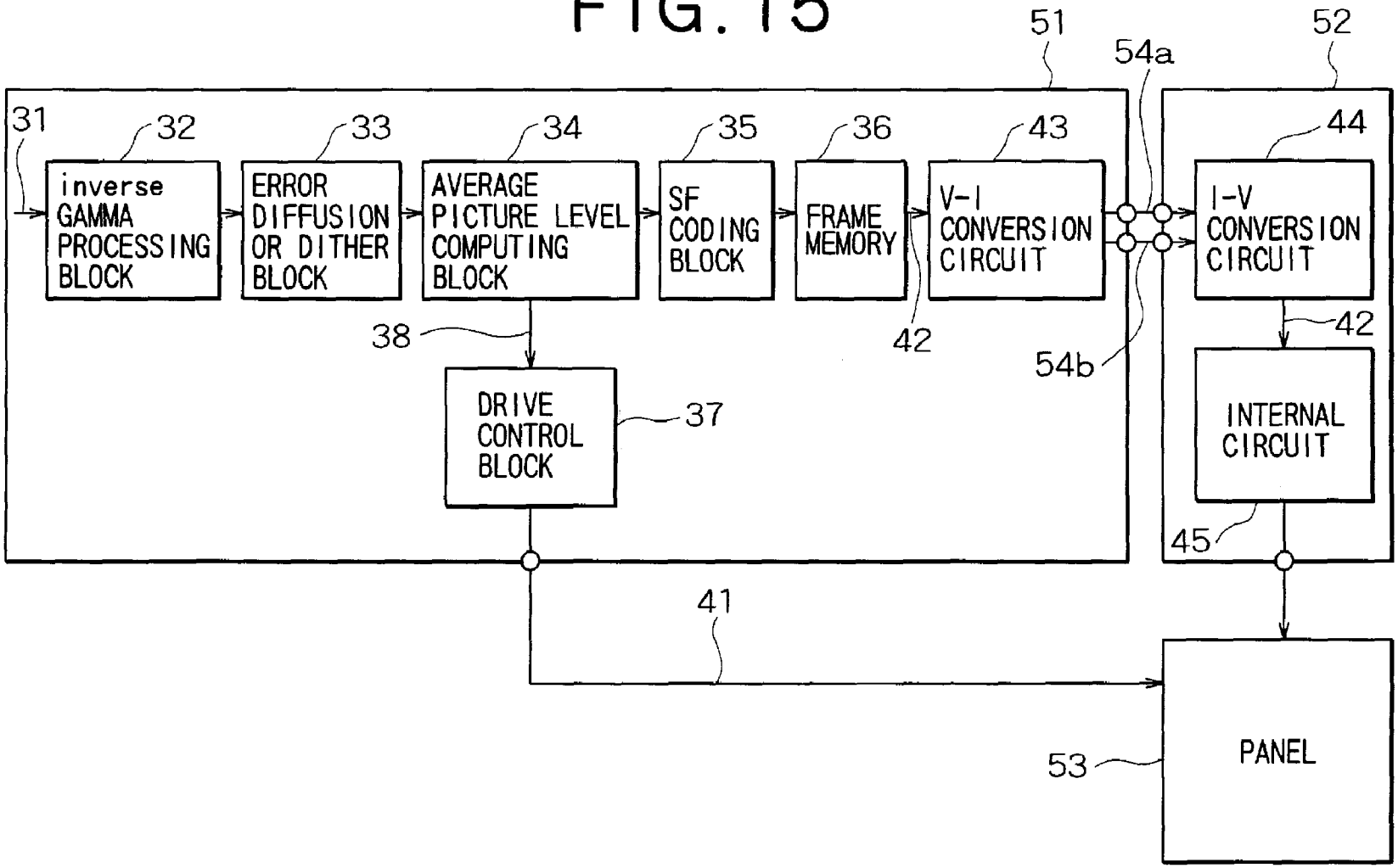
FIG. 15 is a block diagram showing a plasma display panel (PDP) according to a sixth embodiment of the present invention.

Next, description will be made for the sixth embodiment. FIG. 15 is the block diagram showing a plasma display panel (PDP) according to the embodiment. The embodiment is an example where the present invention has been applied to the PDP.

As shown in FIG. 15, the PDP according to the embodiment is provided with a video signal processing circuit 51, a data driver 52 and a panel 53. Further, a pair of wirings 54*a*, 54*b* is provided between the video signal processing circuit 51 and the data driver 52. The video signal processing circuit 51 is provided with an inverse gamma processing block 32, an error diffusion or dither block 33, an average picture level computing block 34, an SF coding block 35, a frame memory 36, a drive control block 37, and a V-I conversion circuit 43. Further, the data driver 52 is provided with an I-V conversion circuit 44 and an internal circuit 45. The V-I conversion circuit 43 is connected to one end of the wirings 54*a*, 54*b*, and the I-V conversion circuit 44 is connected to the other end of the wirings 54*a*, 54*b*. The configuration of the V-I conversion circuit 43 is the same as that of the V-I conversion circuit for image data 8 (refer to FIG. 3) in the above-described first embodiment, and the configuration of the I-V conversion circuit 44 is the same as that of the I-V conversion circuit for image data 21 (refer to FIG. 4) in the above described first embodiment. Moreover, the output signal of the drive control block 37 is designed-to be input to a panel 53.

Next, the driving method of the PDP according to the embodiment will be described. Firstly, as shown in FIG. 15, image data 31 that is a video signal for a TV video, a PC screen or the like is input to the inverse gamma processing block 32. The inverse gamma processing block 32 enhances the gradation resolution of the video signal. For example, the video signal is input as a signal, where each of Red, Green and Blue has an 8-bit gradation, to the inverse gamma processing block 32, and the inverse gamma processing block 32 performs nonlinear conversion to the video signal into the form of $y=x^{2.2}$. At this point, in the case where input gradation accuracy and output gradation accuracy are the same, all input video having a small gradation value such as the gradation values 0, 2 and 5 becomes 0, which cannot express a gradation difference and causes the gradation to deteriorate. To prevent the gradation deterioration, the output of the inverse gamma processing block 32 is generally set to 10 bits. The inverse gamma processing block 32 outputs its output signal (10 bits) to the error diffusion or dither block 33. The error diffusion or dither block 33 spatially diffuses least significant 2 bits out of the gradation resolution 10 bits of the video signal input, for example, and outputs it as an 8-bit signal. The video signal to which the inverse gamma processing and the error diffusion or dither processing have been performed is input to the average picture level computing block 34, the average picture level computing block 34 computes an average picture level (APL) value 38, and outputs the value to the drive control block 37 and the SF coding block 35.

The drive control block 37 converts the APL value 38 into a sustain pulse number that determines the brightness of video, and outputs it as a sustain pulse output 41 to the panel 53. Further, to perform gradation expression on the panel 53, the sub-field (SF) coding block 35 converts the video signal into SF coding data and outputs the data to the frame memory 36. Generally, the 8-bit video signal is converted into 12 pieces of the SF data. The frame memory 36 converts the 12 pieces of the SF data into video signal output 42, and outputs it to the V-I conversion circuit 43. The V-I conversion circuit 43 connects either one of a pair of the wirings 54*a*, 54*b* to the earth electrode (not shown) and sets the other one to the floating state based on the video signal output 42 that is the two-valued voltage signal.

The I-V conversion circuit 44 of the data driver 52 allows the electric current to flow in the wiring out of a pair of the wirings 54*a*, 54*b*, which is connected to the earth electrode. Accordingly, the I-V conversion circuit 44 converts the video signal output 42 into a pair of complementary current signals to receive them, and converts the current signal into the voltage signal to regenerate the video signal output 42. The circuit 44 stops current signal when the video signal output 42 is not transmitted. Then, the I-V conversion circuit 44 outputs the regenerated video signal output 42 to the internal circuit 45.

Subsequently, the internal circuit 45 adjusts transfer timing and transfer speed of the video signal output 42, and transfers it to the data driver (not shown) of the panel 53. Thus, the panel 53 generates writing discharge in each display cell (not shown) of the panel 53 to write wall charge, and thus determines luminescence/non-luminescence of each display cell. On the other hand, the sustain pulse output 41 is transferred to a sustain driver (not shown) of the panel 53, and the pulse number of sustain discharge after the writing discharge in each display cell is determined. Generally, since a pulse interval is constant, the pulse number of each SF (sub-field) corresponds to luminescence time of each SF. Accordingly, the brightness of each display cell is controlled. As described above, the video signal output 42 and the sustain pulse output 41 drive the panel 53 to display a picture.

In the embodiment, the V-I conversion circuit and the I-V conversion circuit, which characterize the present invention, are used in an area where the video signal output is transferred from the video signal processing circuit 51 to the data driver 52. This can realizes high-speed data transfer and reduce the power consumption. Unlike the liquid crystal display device, data write time in the PDP does not contribute to luminescence, so that the data write time can be performed in high-speed insofar as write defect is not caused. Specifically, data write speed can be increased to a point where the write defect to the panel occurs, and the data write speed is determined by the performance of the panel. However, since a few write defects are not conspicuous in the least significant SF, high-speed writing can be performed while permitting the write defects to some extent.

In the PDP, data are transferred by every SF unlike the liquid crystal display device. Therefore, with the method shown in the above-described third embodiment, data equivalent to one SF are compared with each other and encoded, and the data amount can be thus reduced. Particularly, since the data in a most significant SF does not change much even in a natural image, the data amount can be effectively reduced.

Further, write time (transfer time) and luminescence time are set separately in the PDP, so that data are not transferred in time other than the transfer time, that is, a sustain period, a pre-discharge period, or the like. Accordingly, it is possible to stop the receiver (I-V conversion circuit) during the time, and thus exerting large reduction effect of power consumption.

Note that the number of pixels that one data driver drives in the PDP is normally 256 or 192 pixels, for example. Assuming that the number of pixels in one line of the panel is 640 times 3 colors (640×3), 10 data drivers are required to drive 192 pixels. Therefore, it is preferable to transfer data parallelly to the 10 data drivers with the method shown in the above-described fifth embodiment.

Although the above-described first to sixth embodiment have shown the examples where the present invention is applied for the liquid crystal display device or the PDP, the present invention is not limited to them, and can be applied for other matrix type display devices such as the organic EL display panel.

What is claimed is:

1. A display device, comprising:

a pair of or plural pairs of wirings for image data;

a display controller that is connected to one end of said wirings for image data and outputs said image data by connecting either one of each pair of said wirings for image data to a reference potential terminal and setting the other one to a floating state based on the image data; and a source driver that is connected to the other end of said wirings for image data, generates a pair of or plural pairs of complementary current signals based on said image data by allowing electric current to flow in the wiring connected to said reference potential terminal out of a pair of or plural pairs of said wirings for image data and generates a drive signal based on the current signal when said display controller outputs the image data, and does not allow the electric current to flow in both of said wirings for image data when said display controller does not output the image data.

2. The display device according to claim 1, further comprising a pair of wirings for clock signal, wherein said display controller is connected to one end of said wirings for clock signal, outputs said clock signal by connecting either one of a pair of said wirings for clock signal to the reference potential terminal and setting the other one to the floating state based on a clock signal, and said source driver is connected to the other end of said wirings for clock signal, generates a pair of complementary current signals based on said clock signal by allowing electric current to flow in the wiring connected to said reference potential terminal out of a pair of said wirings for clock signal when said display controller outputs the clock signal, and do not allow the electric current to flow in both of said wirings for clock signal when said display controller does not output the clock signal.

3. The display device according to claim 2, wherein said source driver comprises a clock signal conversion circuit that generates a pair of complementary current signals based on said clock signal by allowing the electric current to flow in the wiring connected to said reference potential terminal out of a pair of said wirings for clock signal and regenerates said clock signal based on the current signal, and a detecting circuit for clock signal stop that detects whether said clock signal conversion circuit generates the current signal based on said clock signal or not, and determines according to said detection result whether said display controller is outputting the clock signal or stops outputting the clock signal.

4. The display device according to claim 1, wherein said display controller comprises a timing control circuit that outputs a receiver control signal showing whether said display controller is outputting the image data or stops outputting the image data, and an image data switching circuit that connects either one of each pair of said wirings for image data to the reference potential terminal and sets the other one to the floating state based on the image data output from said timing control circuit, and said source driver, when said receiver control signal shows that the display controller is outputting the image data, generates a pair of or plural pairs of complementary current signals based on said image data by allowing the electric current to flow in the wiring connected to said reference potential terminal out of a pair of or plural pairs of said wirings for image data and regenerates the image data based on the current signal, and stops allowing the electric current to flow in the wirings for image data connected to said reference potential terminal when said receiver control signal shows that the display controller stops outputting the image data.

5. The display device according to claim 1, wherein said display controller comprises a timing control circuit that reads said image data of a predetermined amount to sequentially output the image data, a data comparing circuit that compares a predetermined amount of image data that the timing control circuit has read before one drive timing with a predetermined amount of image data currently read and outputs a result to said timing control circuit, and an image data switching circuit that connects either one of each pair of said wirings for image data to the reference potential terminal and sets the other one to the floating state based on the image data output from said timing control circuit, said timing control circuit outputs the receiver control signal showing whether the display controller is outputting the image data or stops outputting the image data based on the comparison result of said data comparing circuit, and said source driver, when said receiver control signal shows that the display controller is outputting the image data, generates a pair of or plural pairs of complementary current signals based on said image data by allowing the electric current to flow in the wiring connected to said reference potential terminal out of a pair of or plural pairs of said wirings for image data and regenerates said image data based on the current signal, and stops allowing the electric current to flow in the wirings for image data connected to said reference potential terminal when said receiver control signal shows that the display controller stops outputting the image data.

6. The display device according to claim 5, wherein said source driver outputs a signal same as a drive signal that said source driver has output before one drive timing in the case where said data comparing circuit determines that image data of a predetermined amount that said timing control circuit has read before one drive timing is equal to image data currently read.

7. The display device according to claim 5, wherein said source driver outputs an inverted signal of a drive signal that said source driver has output before one drive timing in the case where said data comparing circuit determines that image data of a predetermined amount that said timing control circuit has read before one drive timing is equal to inverted data of image data currently read.

8. The display device according to claim 1, wherein said display panel is a liquid crystal display panel, a plasma display panel, or an organic EL (Electro Luminescence) display panel.

9. The display device according to claim 1, wherein said reference potential terminal is an earth terminal.

10. The display device as claimed in claim 1, further comprising:

a display panel which displays an image based on said drive signal.

11. A display device comprising:

wirings for image data;

a display controller connected to one end of the wirings for image data; and a source driver that is connected to the other end of said wirings for image data and generates a drive signal based on the image data sent out to said wirings for image data;

wherein said display controller adjusts the frequency of said image data according to the display mode of the image, wherein said display controller comprises:

a mode register that outputs a control signal according to the display mode of an image, and a timing control circuit that sequentially outputs said image data by a frequency adjusted based on said control signal and outputs a receiver control signal showing said display mode of the image, and said source driver generates the drive signal based on said display mode of the image that said receiver control signal shows.

12. The display device as claimed in claim 11, further comprising:

a display panel which displays an image based on said drive signal.

13. A display device comprising:

wirings for image data;

a display controller connected to one end of the wirings for image data; and a source driver that is connected to the other end of said wirings for image data and generates a drive signal based on the image data sent out to said wirings for image data;

wherein said display controller adjusts the frequency of said image data according to the display mode of the image, wherein a pair of or plural pairs of said wirings for image data are provided, said display controller has an image data switching control circuit that connects either one of each pair of said wirings for image data to a reference potential terminal and sets the other one to a floating state based on the image data, and said source driver generates a pair of or plural pairs of complementary current signals based on said image data by allowing the electric current to flow in the wiring connected to said reference potential terminal out of said wirings for image data, generates the drive signal based on the current signals, and controls the magnitude of the electric current allowed to flow in said wirings for image data according to said display mode of the image that said receiver control signal shows.

14. The display device as claimed in claim 13, further comprising:

a display panel which displays an image based on said drive signal.

* * * * *